US005668543A

United States Patent [19]

Jones

[11] Patent Number: 5,668,543

[45] Date of Patent: *Sep. 16, 1997

[54] ADVANCE NOTIFICATION SYSTEM AND METHOD UTILIZING PASSENGER CALLING REPORT GENERATOR

[75] Inventor: Martin Kelly Jones, Dalton, Ga.

[73] Assignee: Global Research Systems, Inc., Rome, Ga.

[ * ] Notice: The term of this patent shall not extend beyond the expiration date of Pat. No. 5,657,010.

[21] Appl. No.: 432,666

[22] Filed: May 2, 1995

Related U.S. Application Data

[63] Continuation-in-part of Ser. No. 407,319, Mar. 20, 1995, abandoned, which is a continuation-in-part of Ser. No. 63,533, May 18, 1993, Pat. No. 5,400,020.

[51] Int. Cl.[6] ..... G08G 1/123

[52] U.S. Cl. ..... 340/994; 340/988

[58] Field of Search ..... 340/905, 988, 340/989, 990, 992, 994; 379/58, 59, 201, 204; 364/436; 455/53.1, 54.1

[56] References Cited

U.S. PATENT DOCUMENTS

| | | | |
|---|---|---|---|
| 4,325,057 | 4/1982 | Bishop | 340/994 |
| 4,350,969 | 9/1982 | Greer | 455/38.4 |
| 4,713,661 | 12/1987 | Boone et al. | 340/539 |
| 4,799,162 | 1/1989 | Shinkawa et al. | 340/994 |
| 4,812,843 | 3/1989 | Champion, III et al. | 364/436 |
| 5,021,780 | 6/1991 | Fabiano et al. | 340/539 |
| 5,131,020 | 7/1992 | Liebeshy et al. | 379/100 |
| 5,144,301 | 9/1992 | Jackson et al. | 340/994 |
| 5,218,629 | 6/1993 | Dumond, Jr. et al. | 379/58 |
| 5,400,020 | 3/1995 | Jones et al. | 379/58 |
| 5,444,444 | 8/1995 | Ross | 340/994 |

FOREIGN PATENT DOCUMENTS

| | | | |
|---|---|---|---|
| 2559930 | 8/1985 | France | 340/995 |
| 2674355 | 9/1992 | France | 340/994 |
| 0066175 | 6/1977 | Japan | 340/994 |
| 0288400 | 11/1988 | Japan | 340/994 |

*Primary Examiner*—Brent A. Swarthout
*Attorney, Agent, or Firm*—Thomas, Kayden, Horstemeyer & Risley

[57] ABSTRACT

An advance notification system (10) and method notifies passengers of the impending arrival of a transportation vehicle (19), for example, a school bus, at a particular vehicle stop. The system (10) generally includes an on-board vehicle control unit (VCU) (12) for each vehicle (19) and a base station control unit (BSCU) (14) for making telephone calls to passengers in order to inform the passengers when the vehicle (19) is a certain predefined time period and/or distance away from the vehicle stop. The VCU (12) compares elapsed time and/or travelled distance to the programmed scheduled time and/or travelled distance to determine if the vehicle (19) is on schedule. If the vehicle (19) is behind or ahead of schedule, the VCU (12) calls the BSCU (14), which then adjusts its calling schedule accordingly. Significantly, a calling report generator (11) in the BSCU (14) allows a subscribing passenger to solicit a calling report from the BSCU (14) that indicates the time(s) and outcome (s) of any previous notification attempt(s) by the BSCU (14) to the passenger telephone (29).

80 Claims, 8 Drawing Sheets

ADVANCE NOTIFICATION SYSTEM AND METHOD UTILIZING PASSENGER CALLING REPORT GENERATOR

This document is a continuation-in-part of the application entitled "ADVANCE NOTIFICATION SYSTEM AND METHOD UTILIZING A DISTINCTIVE TELEPHONE RING" filed Mar. 20, 1995 by Jones et al. that was assigned Ser. No. 08/407,319, now abandoned; which is a continuation-in-part of the application entitled "ADVANCE NOTIFICATION SYSTEM AND METHOD" filed May 18, 1993 by Jones et al. that was assigned Ser. No. 08/063,533, now U.S. Pat. No. 5,400,020 to Jones et al. that issued on Mar. 21, 1995.

FIELD OF THE INVENTION

The present invention generally relates to data communications and information systems and, more particularly, to an advance notification system and method for notifying persons in advance of the impending arrival of a transportation vehicle, for example but not limited to, a bus, train, plane, fishing vessel, or other vessel, at a particular vehicle stop.

BACKGROUND OF THE INVENTION

There are many situations when it is desirable for passengers to know of the approximate arrival time of a particular transportation vehicle shortly before the vehicle is to arrive at a particular destination. With such information, passengers can adjust their schedules accordingly and avoid having to wait on the particular vehicle to reach the particular destination. For example, a person having to pick up a friend or relative at a commercial bus station either has to call the bus station to find out the approximate arrival time, which information is oftentimes unavailable, or plan on arriving at the bus station prior to the scheduled arrival time of the bus and hope the bus is not delayed.

Another example is in the commercial fishing industry, wherein fish markets, restaurants, and other establishments desire to purchase fish immediately upon arrival of a commercial fishing boat at a port. Currently, such establishments, in order to ensure being able to purchase the freshest catch, often depend on predetermined schedules of fishing fleets, which are not always accurate or reliable.

Still another example involves school children who ride school buses. School children who ride buses to school often have to wait at their bus stops for extended lengths of time because school buses arrive at a particular bus stop at substantially different times from one day to the next. The reason is that school buses are not always the best maintained vehicles on the roads, frequently must operate during rush hour traffic, and must contend with congested urban/suburban conditions. As a result, school children are forced to wait at their bus stops for long periods of time, oftentimes in adverse weather conditions, on unlit street corners, or in hazardous conditions near busy or secluded streets. If it is raining, snowing, windy and cold, or even dark, such conditions can be unhealthy and unsafe for children.

Thus, generally, it would be desirable for a passenger to know when a vessel, such as a bus, train, plane, or the like, is a particular time period (number of minutes or seconds) from arriving at a destination so that the passenger can adjust his/her schedule and avoid arriving too early or late.

In the past, in order to combat the arrival time problem in the context of school buses, student notification systems have been employed that use a transmitter on each bus and a receiver inside each student home. U.S. Pat. No. 4,713,661 to Boone et al. and U.S. Pat. No. 4,350,969 describe systems of this type. When the school bus and its on-board transmitter come within range of a particular home receiver, the transmitter sends a signal to the receiver, which in turn produces an indicator signal to notify the student that his/her school bus is nearby. While such notification systems work satisfactorily under certain circumstances, nevertheless, these systems are limited by the range of the transmitters and require the purchase of relatively expensive receivers for each student. In addition, such systems provide little flexibility for providing additional information to the students, such as notifying them of the delayed arrival of a bus, alternative bus route information, or information regarding important school events.

SUMMARY OF THE INVENTION

An object of the present invention is to overcome the deficiencies and inadequacies of the prior art as noted above and as generally known in the industry.

Another object of the present invention is to provide an advance notification system and method for according advance notification of the impending arrival of a vehicle at a particular vehicle stop.

Another object of the present invention is to provide an advance notification system and method for according advance notification to school students of the impending arrival of a school bus at a particular bus stop.

Another object of the present invention is to provide an advance notification system and method for inexpensively according advance notification of the impending arrival of a vehicle at a particular vehicle stop.

Another object of the present invention is to provide an advance notification system that is reliable in operation and flexible in design to permit customization to a particular application.

Briefly described, the present invention is an advance notification system for notifying passengers of an impending arrival of a vehicle as the vehicle progresses along a scheduled route with particular stop locations and corresponding scheduled times of arrival at the stop locations. The advance notification system generally comprises a vehicle control unit (VCU) disposed on each vehicle and a base station control unit (BSCU) which is configured to communicate with all of the vehicle control units and with passenger telephones.

The VCU includes a vehicle control mechanism, a vehicle communication mechanism controlled by the vehicle control mechanism, a vehicle clock for tracking elapsed time of the vehicle while on the scheduled route to determine when the vehicle is early, late, and on time along the scheduled route, optional input switches (e.g., start/reset, advance stop number, move stop number back) that can be operated by the vehicle driver to indicate when the vehicle has reached particular stops along the route, and optional sensors (e.g., odometer, door sensor, swing arm sensor, bus stop sensor, positioning system input, etc.) for signalling to the vehicle control mechanism when the vehicle is early, late, and on time along the scheduled route. The control mechanism is adapted to initiate calls utilizing the vehicle communication mechanism when the elapsed time and/or travelled distance of the vehicle at any of the particular positions is either ahead or behind the scheduled time and/or distance. In the preferred embodiment, the vehicle communication mechanism is a wireless communication interface, such as a mobile telephone, radio frequency (RF) transceiver, or other suitable device.

The BSCU has a base station communication mechanism and a base station control mechanism for controlling the base station communication mechanism. The base station communication mechanism receives the calls from the VCU and receives the amount of time and/or distance in which the vehicle is ahead or behind relative to the schedule. The base station control mechanism causes calls to be made to each of the passengers to be boarded at a particular stop location via the base station communication mechanism prior to the arrival of the vehicle at the particular stop location. In the preferred embodiment, the base station communication mechanism is a wireless communication device, such as a mobile telephone or RF transceiver (includes both transmitter and receiver), for communicating with the vehicle communication mechanism and also comprises at least one telephone for calling passenger telephones.

The telephone call to advise a passenger of the impending arrival of the vehicle preferably can exhibit a distinctive telephone ring sound so that the call recipient need not answer the telephone in order to receive the message. Moreover, the distinctive telephone ring sound can be coded by any sequence and duration of rings and/or silent periods.

In accordance with a significant feature of the present invention, a calling report generator in the BSCU allows a subscribing passenger to solicit a calling report from the BSCU. The report can indicate the time(s) and outcome(s) of any previous notification attempt(s) by the BSCU to the passenger telephone.

It should be emphasized that while the present invention is particularly suited for application to school buses, there are many other applications. As examples, the advance notification system and method of the present invention could be employed with commercial buses, trains, planes, pickup vehicles, delivery vehicles, fishing vessels, and numerous other transportation vehicles.

Other objects, features, and advantages of the present invention will become apparent from the following specification, when read in conjunction with the accompanying drawings. All such additional objects, features, and advantages are intended to be included herein.

BRIEF DESCRIPTION OF THE DRAWINGS

The present invention can be better understood with reference to the following drawings. The drawings are not necessarily to scale, emphasis instead being placed upon clearly illustrating principles of the present invention.

DETAILED DESCRIPTION OF THE PREFERRED EMBODIMENT

The features and principles of the present invention will now be described relative to a preferred embodiment thereof. It will be apparent to those skilled in the art that numerous variations or modifications may be made to the preferred embodiment without departing from the spirit and scope of the present invention. Thus, such variations and modifications are intended to be included herein within the scope of the present invention, as set forth in the claims.

I. System Architecture

Figure 1:
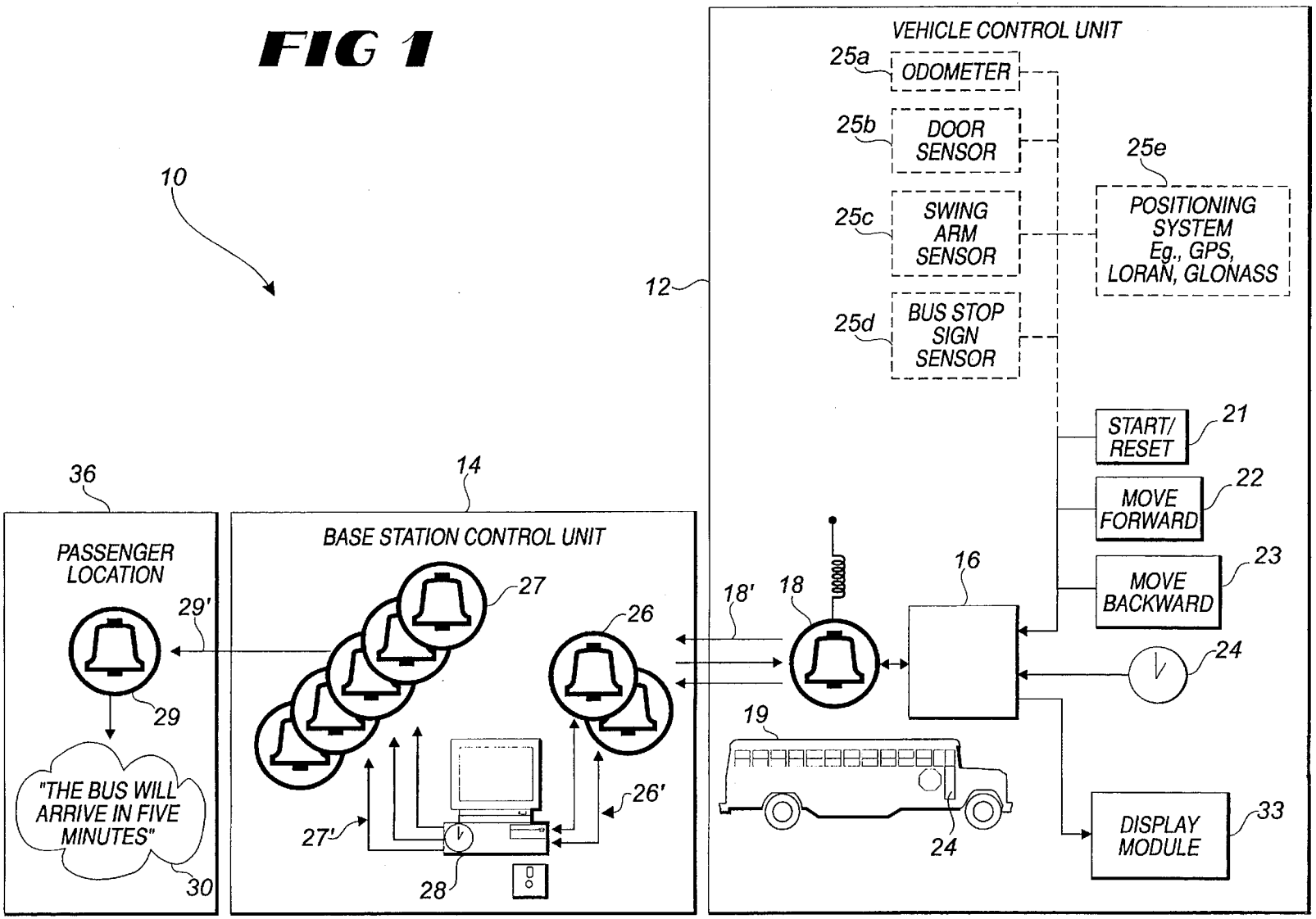
FIG. 1 is a high level schematic diagram of an advance notification system of the present invention as applied to a school bus system, as an example, the advance notification system generally comprising vehicle control units (VCU) in communication with a base station control unit (BSCU), which are in turn in communication with passenger telephones.

Referring now in more detail to the drawings, wherein like reference numerals designate corresponding parts throughout the several views, FIG. 1 is a schematic diagram of the advance notification system 10 of the present invention as configured to operate in, for example but not limited to, a school bus system. The advance notification system 10 comprises, preferably, a plurality of on-board vehicle control units (VCU) 12, a single base station control unit (BSCU) 14, and a plurality of passenger telephones 29. As configured in the school bus system 10, a VCU 12 is installed in each of a plurality of school buses 19, all of which communicate with the single BSCU 14. Moreover, the BSCU 14 communicates with a telephone 29 at one or more passenger locations 36, or student homes in the present exemplary application.

A. Vehicle Control Unit

The VCU 12 will now be described with reference to FIGS. 1, 2, and 3. Referring first to FIG. 1, each VCU 12 comprises a microprocessor controller 16, preferably a model MC68HC705C8P microprocessor controller that is manufactured by and commercially available from the Motorola Corporation, U.S.A. The microprocessor controller 16 is electrically interfaced with a communication mechanism 18, preferably a wireless communication device, for enabling intercommunication of data with the BSCU unit 14. Examples of suitable wireless communication devices include a mobile telephone (e.g., cellular) and a transceiver (having both a transmitter and receiver) operating at a suitable electromagnetic frequency range, perhaps the radio frequency (RF) range.

In the embodiment using a wireless RF transceiver as the communication mechanism 18, data can be sent in bursts in the form of in-band tones, commonly called "twinkle tones." These tone bursts can occur in the background of an existing voice channel. Twinkle tones are oftentimes used in transportation systems, such as taxi cab communications systems.

Figure 5:
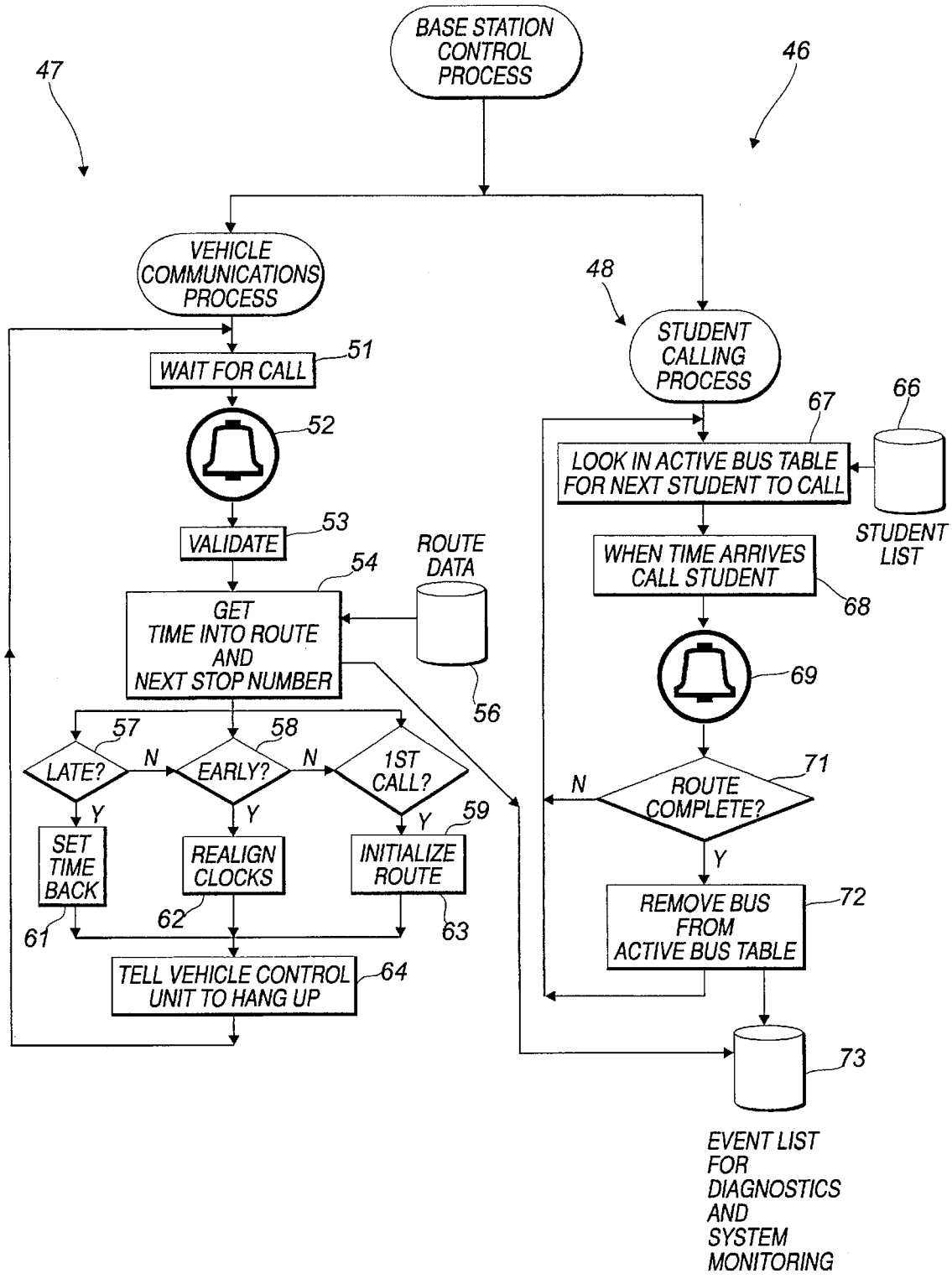
FIG. 5 is a flow chart of a base station control program for the base station control unit 14 of FIG. 1 that includes a vehicle communications program and a student calling program.

The microprocessor controller 16 is electrically interfaced with a start/reset switch 21, a move forward switch 22, a move backward switch 23, a clock 24, and optionally, sensors 25*a*–25*d*. Generally, vehicle tracking is accomplished by monitoring the control switches 21–23, the sensors 25*a*–25*e*, the power to the controller 16, and a route database (FIG. 5). It is recommended that all of the foregoing features be employed to provide redundant checking.

More specifically, the start/reset switch 21 can be actuated by the bus driver upon starting along the bus's scheduled route to initialize the system 10. The move forward switch 22 can be actuated by the bus driver upon reaching a bus stop in order to inform the VCU 12 that a stop has been made, the details of which will be further described hereinafter. The move backward switch 23 can be actuated by the bus driver at a bus stop if the bus driver has erroneously toggled the move forward switch 22 too many times, as will be further described in detail hereinafter. This indicates to the microprocessor controller 16 that a display module 33 and memory must be updated. In essence, the move forward switch 22 and the move backward switch 23 cause the next stop designation which is displayed on the display module 33 and stored in the VCU 12 to toggle forward and backward, respectively.

The VCU 12 can be configured so that the operation of the start/reset switch 21, the move forward switch 22, and the move backward switch 23 is purely optional by the bus driver. In this configuration, the sensors 25*a*–25*e* automatically accomplish the aforementioned functions of the switches 21–23. However, in certain cases, the bus driver may want to use the switches to override the sensors 25*a*–25*e*. One of these cases may be when a student rides a bus only two out of five school days. Rather than program the VCU 12 to track these unnecessary stops, the driver may manually control the stop number by the switches 21–23.

The clock 24 tracks the elapsed time as the bus travels along its scheduled route and feeds the timing information to the microprocessor controller 16.

The display module 33 informs the bus driver as to the number corresponding to the next stop and the time (preferably, in seconds) necessary to reach the next stop. Other types of information may also be displayed on the display module 33. For example, the display module 33 may display the amount of time that the bus 19 is ahead of or behind schedule, the status of the VCU 12 in communication with the BSCU 14, or, upon actuation of start button 21, that the advance notification system 10 is operating.

The optional sensors 25*a*–25*e* include an odometer sensor 25*a* for determining distance into a route. This sensor 25*a* can be connected to the bus drive shaft and counts revolutions. This data can be used to determine the stop number.

A door sensor 25*b* can be used to count the number of door operations (opening/closing) of the front door 24 of the school bus 19, which should correspond with the number of stops.

A swing arm sensor 25*c* can be implemented to count the number of times the arm operates. This operation should coincide with the number of stops.

A bus stop sign sensor 25*d* can be utilized to count the number of times the bus stop sign operates. This operation should coincide with the number of stops.

A positioning system 25*e* can be used to determine the geographical position of the bus 19 on the earth's surface. The positioning system 25*e* could be the GPS (global positioning system), the LORAN positioning system, the GLONASS positioning system (USSR version of GPS), or some other similar position tracking system.

Figure 2:
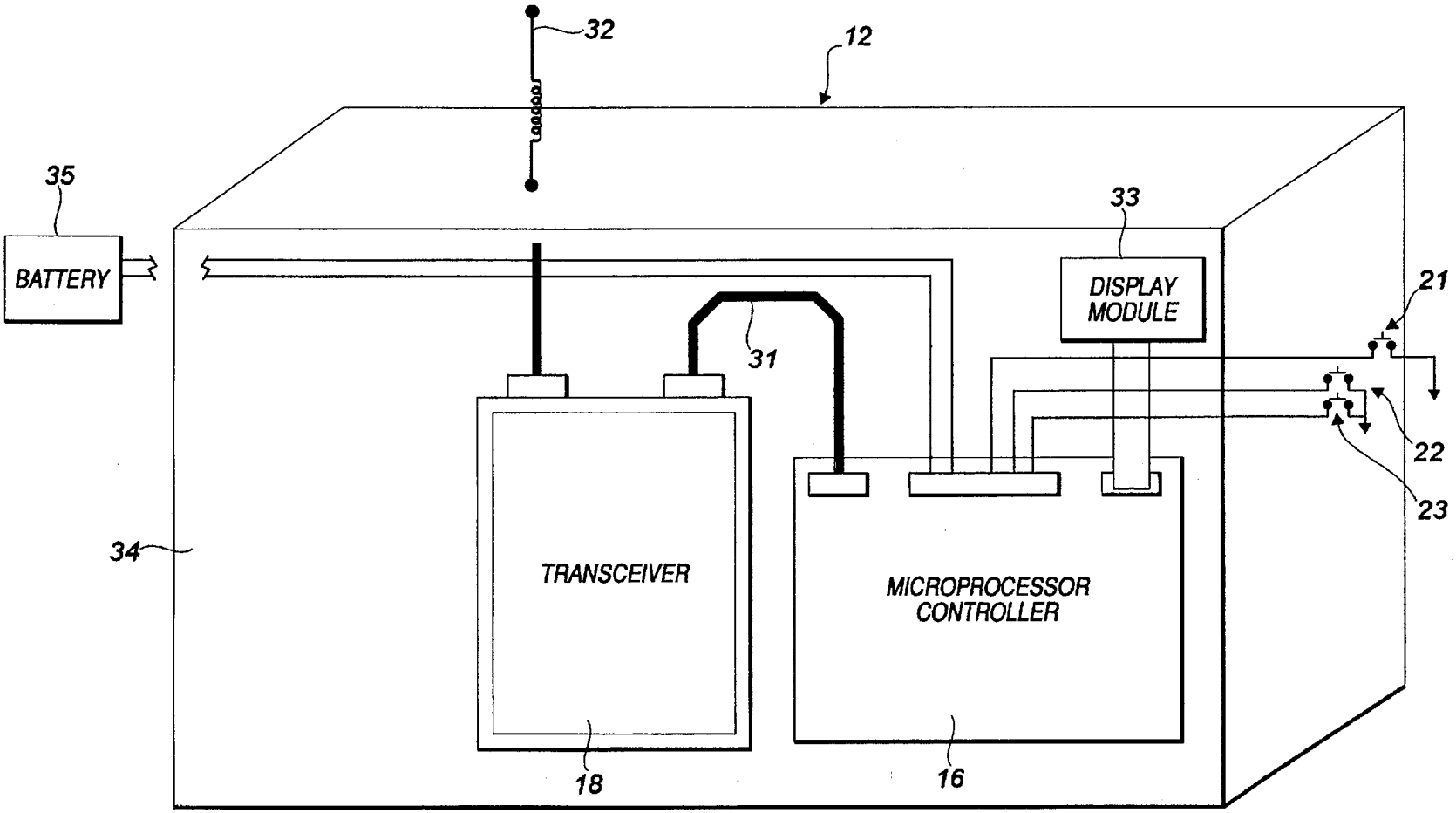
FIG. 2 is a high level block diagram of the VCU of the advance notification system of FIG. 1.

FIG. 2 is a high level schematic circuit diagram of the VCU 12. The VCU 12 is designed to be a compact unit with a generally rectangular housing 34 that is mounted preferably on or in front of the dashboard of the bus 19 in view and within reach of the bus driver. In the housing 34, the microprocessor controller 16 is interfaced with the transceiver 18 by a transceiver jack 31 (preferably a conventional 8-conductor telephone jack when transceiver 18 is a mobile telephone), and the transceiver 18 includes an antenna 32 for transmitting and receiving signals to and from the BSCU 14. Further, the VCU 12 includes a liquid crystal display (LCD) module 33 disposed for external viewing of the display by the bus driver for providing information to the bus driver, as described previously.

Figure 3A:
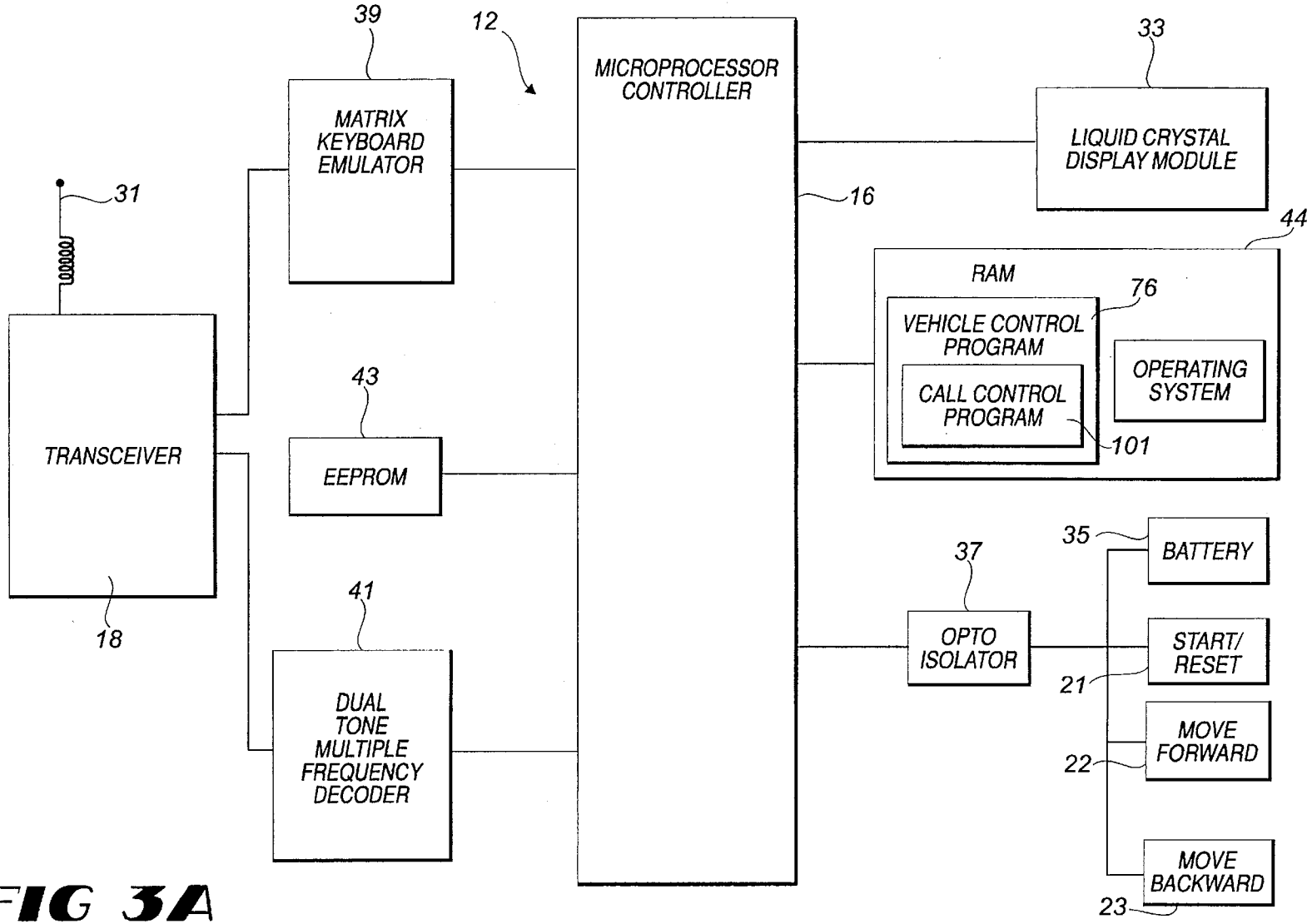
FIG. 3A is a low level block diagram of the VCU of FIG. 1.

FIG. 3A is a more detailed schematic circuit diagram of the electronic components associated with the VCU 12. The microprocessor controller 16 essentially controls the operation of the transceiver 18 and the LCD display module 33. A switching element 37, such as an optical isolator (opto isolator) unit 37, provides a buffer between the microprocessor controller 16 and the battery 35 as well as switches 21, 22, 23. An EEPROM 43 is provided for storing the control programs (FIGS. 6 and 7) and other requisite data for the microprocessor controller 16, and a RAM 44 is provided for running the control programs in the microprocessor controller 16. A matrix keyboard emulator 39 is interfaced between the transceiver 18 and the microprocessor controller 16 for allowing the microprocessor controller to control and transmit signals over the transceiver 18. Further, a dual tone multiple frequency decoder 41 is interfaced between the mobile telephone 18 and the microprocessor controller 16 for decoding modem signals, or tones, received by the mobile telephone 18 from the BSCU 14.

B. Base Station Control Unit

The BSCU 14 can be implemented by any conventional computer with suitable processing capabilities for implementing the functionality described hereafter. The BSCU 14 is now described with reference to FIGS. 1 and 3B.

In general, as shown in FIG. 1, the BSCU 14 includes at least one transceiver 26 (for example, a mobile telephone or RF transceiver) and associated communication connection 26' dedicated for communication with the one or more VCU transceivers 18 associated with the respective one or more VCUs 12. Moreover, the BSCU 14 can communicate to one or more passenger telephones 29, or student homes, via the telephone interface(s) 27 and telephone connection(s) 29'.

Figure 3B:
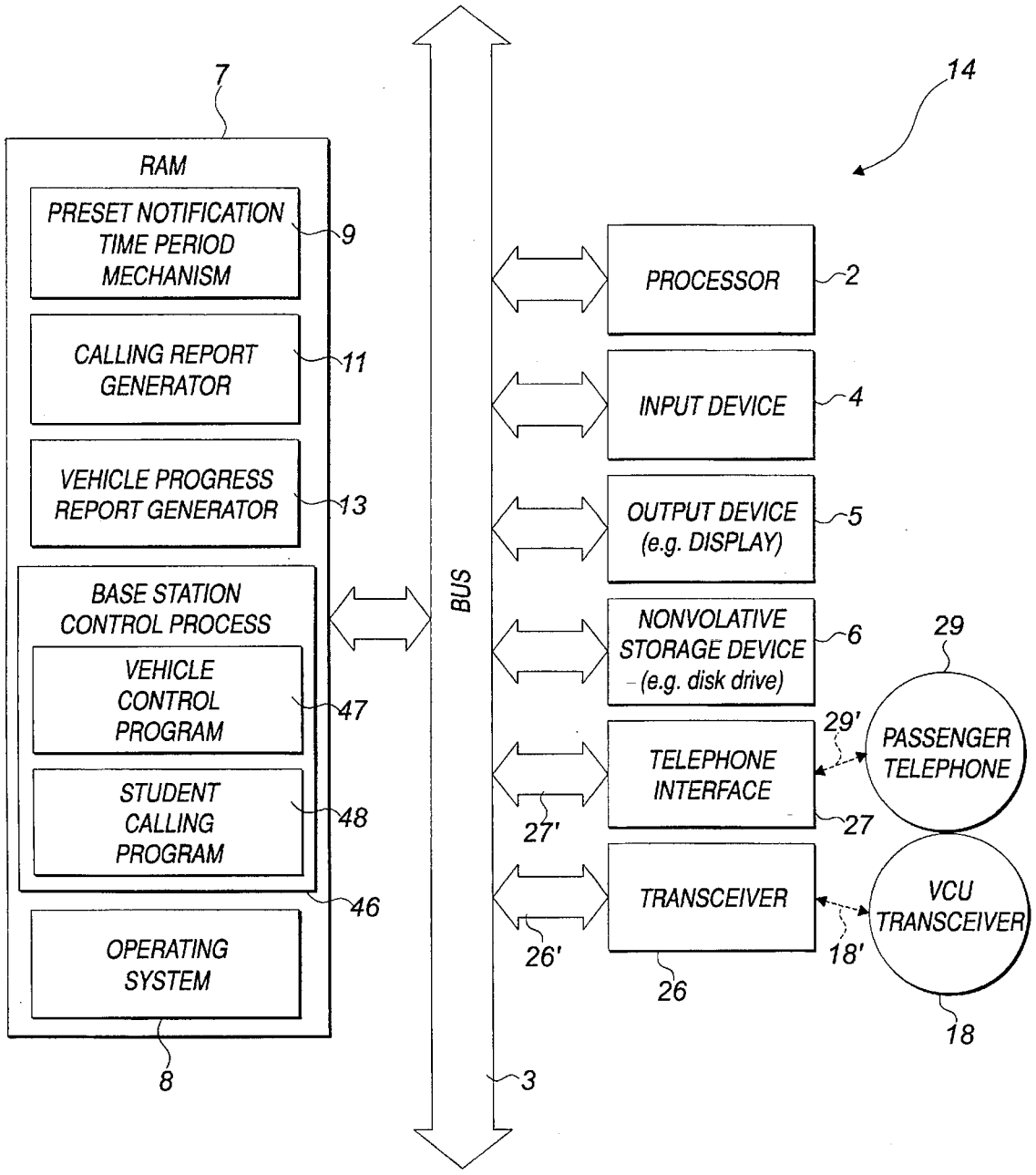
FIG. 3B is a block diagram of the BSCU of FIG. 1.

As illustrated in FIG. 3B, the BSCU 14 contains a conventional processor 2. The processor 2 intercommunicates with and controls the other elements within the BSCU 14 over a system bus 3. An input device(s) 4, for example, a keyboard or mouse, is used to input data from a user (perhaps a fleet operator) of the BSCU 14, and an output device(s) 5, such as a display or printer, is used to output data to the user. A nonvolatile storage device 6, for example, a hard disk drive or CDROM mechanism, may be used to permanently store the software of the BSCU 14, as well as to store the data bases generated by the BSCU 14.

A high speed volatile memory 7, such as a conventional random access memory (RAM), contains the software for driving the processor 2 during operation of the BSCU 14. Particularly, the RAM 7 is loaded with a conventional operating system software (e.g., DOS, UNIX, etc.) for supporting and implementing other software programs for implementing various novel features of the BSCU 14. These other software programs preferably include a preset notification time period mechanism 9, a calling report generator 11, a vehicle progress report generator 13, and a base station control program 46 (FIG. 5) that has a vehicle communications program 47, and a student calling program 48. The foregoing software programs are loaded as needed into the RAM 7, as needed, by the processor 2.

The preset notification time period mechanism 9 permits the passenger to define a preset notification time period when the passenger is to receive a telephone call prior to arrival of a vehicle 19 at a vehicle stop to thereby indicate impending arrival of the vehicle 19 at the stop. The preset notification time period mechanism 9 can be implemented in software in many different manners, as is well known to someone with skill in the art. Preferably, the preset notification time period mechanism 9 allows a passenger to define the period by (a) establishing a telephone communication link with the system telephone interface 27 and (b) providing the preset notification time period to the mechanism 9 during the telephone communication link.

The calling report generator 11 can be implemented in a variety of ways in software and is preferably configured to permit the passenger to solicit a calling report corresponding to one or more previous telephone calls made by the system telephone interface 27 to the passenger telephone 29. In order to obtain the calling report, the passenger (a) establishes a telephone communication link with the system telephone interface 27 and (b) requests the report. In turn, the calling report generator 11 provides the calling report to the passenger in real time during the telephone communication link. The calling report can be configured to indicate whether the passenger telephone 29 was busy, was answered, was not answered, or was out of service, when the system telephone interface 27 initiated the previous telephone call(s) to the passenger telephone 29. Further, the calling report can be designed to include a time(s) when the previous telephone call(s) was (were) initiated by the system telephone interface 27 to the passenger telephone 29.

The vehicle progress report generator 13 may be implemented in many different ways in software and is configured to permit the passenger to solicit a vehicle progress report relating to arrival of the vehicle 19 at the vehicle stop. Preferably, a passenger can solicit a vehicle progress report from the vehicle progress report generator 13 by (a) establishing a telephone communication link with the system telephone interface 27 and (b) requesting the report. In turn, the vehicle progress report generator 13 provides the report to the passenger in real time during the telephone link. When the vehicle 19 is currently approaching the stop, a time indicating when the vehicle 19 is to arrive at the stop can be specified in the vehicle progress report. When the vehicle 19 has already arrived at the stop, a past arrival time can be specified in the progress report. Furthermore, the progress report may include a time(s) when a previous call(s) was initiated by the system telephone interface 27 to the passenger telephone 29.

As shown in FIG. 3B, the BSCU 14 further includes at least one transceiver 26 (for example, a mobile telephone or RF transceiver) and associated communication connection 26' dedicated for communication with the one or more VCU transceivers 18 associated with the respective one or more VCUs 12. The vehicle communications program 47 (FIG. 5) drives the processor 2 to control the transceiver 26 and communications associated therewith.

The BSCU 14 can communicate to one or more passenger telephones 29, or student homes, via the telephone interface (s) 27 and telephone connection(s) 29'. The telephone interface 27 can be, for example but not limited to, any of the following interfaces: (a) a voice card(s) (preferably multiple port) and/or telephone; (b) a high-speed switch-computer applications interface(s) (SCAI) that communicates to a digital switch operated by a telephone utility company; the SCAI adheres to the conventional OSI model and supports the carrying of application information in an application independent fashion; and (c) an interface that communicates with an analog display services interface(s) (ADSI) maintained by a telephone utility company. ADSI is a cost effective technology that delivers voice and data information between a telephone terminal and a digital switch or server using existing copper telephone lines.

The BSCU 14 could be configured to merely call passengers, thus warning them of the impending arrival of a bus 19, as opposed to forwarding both a call and a message. Specifically, the student calling program 48 (FIG. 5) for the advance notification system 10 can be designed to make the telephone calls to the homes 36 of the students and allow the telephone to ring a predefined number of times so that it is not necessary for the telephone to be answered in order for the telephone call to be recognized as that of the advance notification system 10.

The student calling program 48 (FIG. 5) associated with the advance notification system 10 can also be configured to make the passenger telephone 29 exhibit a distinctive telephone ring sound, or pattern, so that the call recipient need not answer the telephone in order to receive the message. The distinctive telephone ring can be coded by any sequence and duration of rings and/or silent periods. A standard ring signal that is sent to a telephone from the telephone utility company is typically a periodic electrical analog signal having a frequency of 20 Hz and a peak-to-peak voltage amplitude of −48 volts. The ring signal is asserted on the telephone connection 29' for a predefined time period for ringing the telephone. The foregoing time period can be manipulated in order to derive a distinctive sequence and duration of rings and/or silent periods.

Implementation of a distinctive telephone ring can be accomplished by purchasing this feature from a telephone utility company. This feature is widely available to the public. Generally, telephone utility companies operate network switches, now usually digital, that serve as interfaces for telephonic communications. A particular geographic region is typically allocated to a particular switch(s). In essence, one or more distinctive telephone rings can be driven by software running in the switches to a particular telephone. Examples of switches that are commercially available to telephone utility companies are as follows: a model DMS100 by Northern Telecom, Canada; a model 5ESS by AT&T, U.S.A.; and a model EWSD by Siemans Stromberg-Carlson Corp., Germany.

The feature for establishing the distinctive telephone ring is sold to the public under several different commercial trade names, depending upon the telephone utility company. Examples are as follows: Call Selector by Northern Telecom, Canada; Ringmaster by Bell South, U.S.A.; Smartlink by SNET, U.S.A.; Multi-ring by Ameritech, U.S.A.; Priority Ring by PacBell, U.S.A.; Priority Call by Cincinnati Bell, U.S.A.; and Ring Me by Standard Telephone Co., U.S.A.

Furthermore, in the case where a parent or a student answers the telephone call from the base station unit 14, a prerecorded message may be played by the BSCU 14. An example of such a message would be: "The bus will arrive in five minutes," as indicated in FIG. 1 at the reference numeral 30.

II. System Operation

A. Initialization

Initially, the bus schedule for each bus 19 is programmed into the advance notification system 10 by having the respective bus driver drive his respective bus one time along the corresponding scheduled bus route at the approximate speed the bus would usually travel on the route and with the bus driver making all the scheduled stops along the route and waiting at each stop for the approximate time it would take for all the students at that stop to board the bus 19. As the bus driver drives the bus 19 along the route for initialization purposes, the internal real time clock 24 runs and the bus driver actuates the switches 21, 22, 23 as required in accordance with the principles described previously. The timing information is recorded in the memory (RAM44 and EEPROM 43) of the VCU 12.

The timing information which is recorded during the initialization of the system 10 is used as a reference during the usual operation of the system 10 for the purpose of determining whether a bus 19 is early or late at each of the bus stops. In the preferred embodiment, determining the status (i.e., early, on time, late) of a bus 19 is accomplished by comparing the time at which a bus 19 actually departs from a stop to the scheduled time of departure.

However, it should be emphasized that other methodologies could be utilized for determining whether the bus 19 is early or late at an instance in time. For example, the odometer 25*a* of the bus 19, as indicated by phantom lines in FIG. 1, could be monitored by the microprocessor controller 16. At particular times, the odometer mileage reading could be compared to reference odometer mileage readings which were obtained during the initialization of the system 10. In this way, the determination of whether a bus 19 is early or late can occur at any time during a bus route and can occur as many times as desired.

Another methodology which could be utilized for determining whether the bus 19 is early or late involves interfacing the VCU 12 with the positioning system 25*e*, as shown in FIG. 1 by phantom lines. From the geographical position data received from the positioning system 25*e*, the microprocessor controller 16 could determine where the bus 19 is situated on the earth at any given time. The bus location at a particular time could then be compared with scheduled locations and scheduled times in order to determine whether the bus 19 is early or late and by what amount.

B. Regular Operation

Figure 4A:
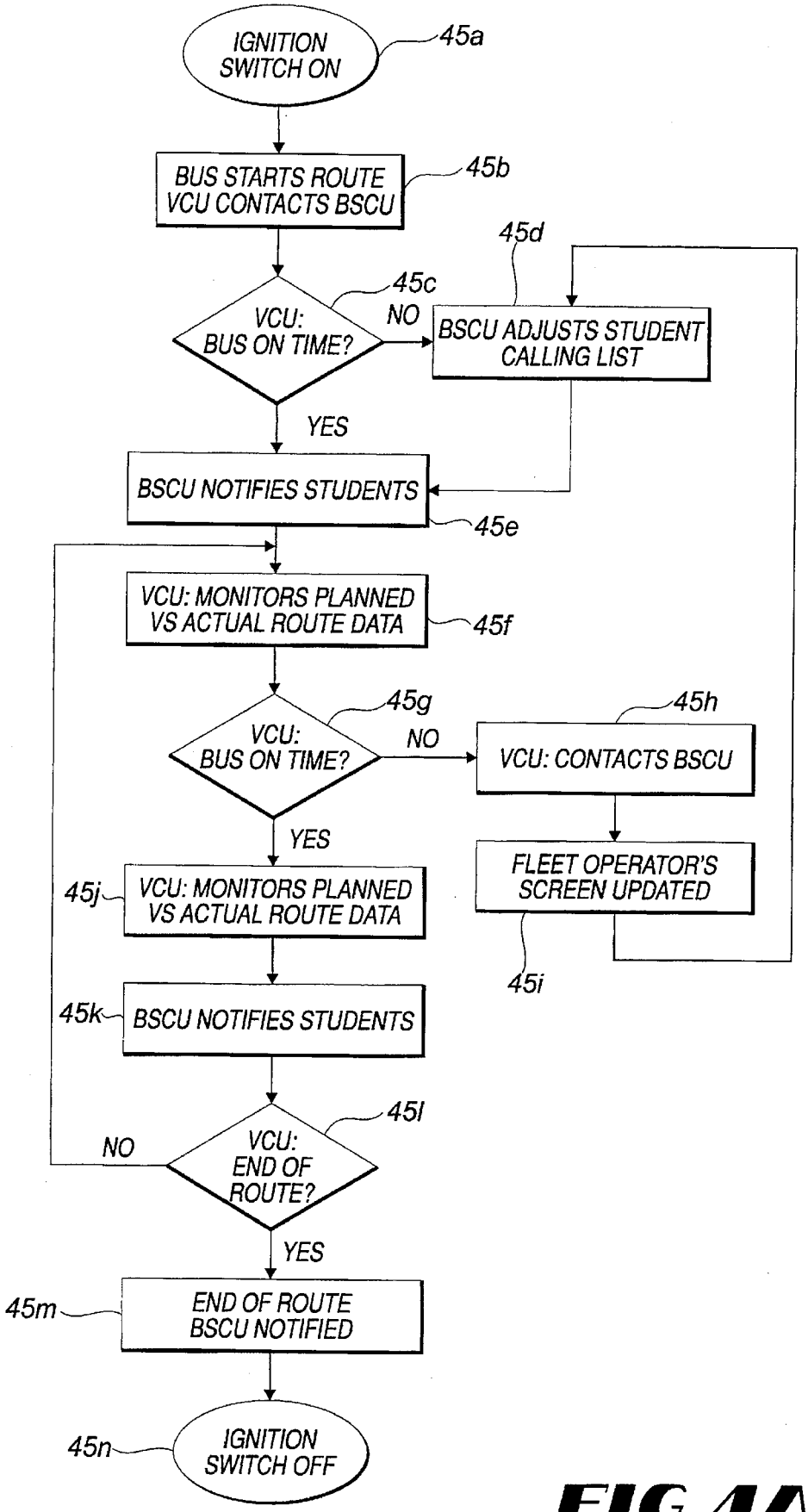
FIG. 4A is a flow chart of the overall operation of the advance notification system of FIG. 1.
Figure 4B:
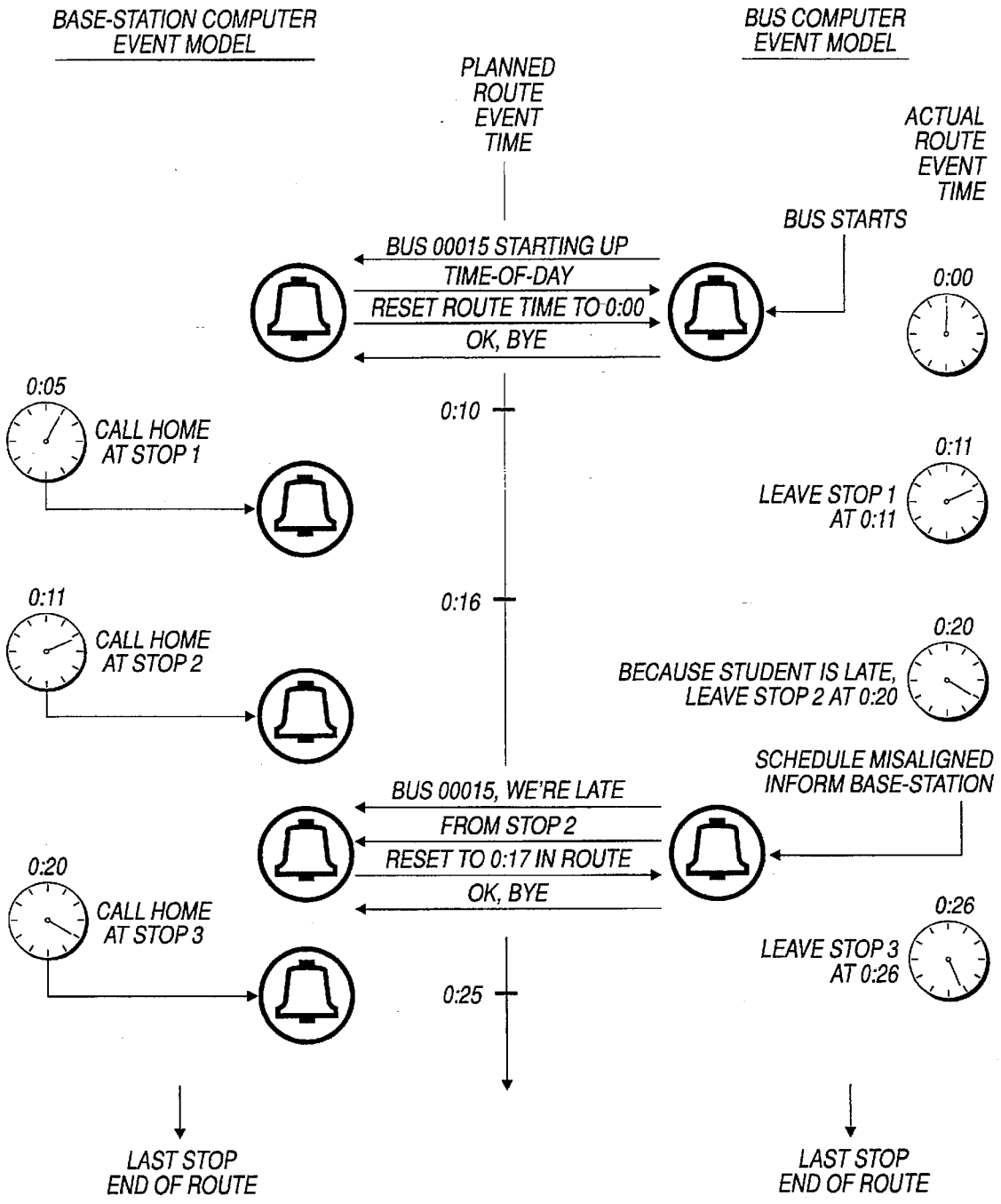
FIG. 4B is an example of a schedule for a sequence of events illustrating the operation of the advance notification system of FIG. 1.

The overall operation of the advance notification system 10 will be described with reference to FIGS. 4A and 4B. FIG. 4A sets forth a flow chart showing the overall operation after the system 10 has been initialized. FIG. 4B shows an example of a schedule of possible events and the interactions which might occur between the VCU 12 and the BSCU 14 as the bus 19 travels along its scheduled route and makes its scheduled stops.

In FIG. 4B, the left hand column illustrates the sequence of events for the BSCU 14, and the right hand column illustrates the sequence of events on the VCU 12. Between the right and left hand columns is illustrated a time line for the scheduled bus stops. The time line has the following time designations: ten minutes, sixteen minutes, and twenty-two minutes, all along the scheduled bus route.

First, the bus ignition is switched on, as indicated in FIG. 4A at block 45*a*. At the beginning of the bus route, the system 10 could be configured to automatically initialize itself upon power up of the VCU 12, and further, the unit 12 could be programmed to make initial contact with the BSCU 14 after the bus 19 moves a predefined distance, such as ⅛ mile, as determined by the odometer sensor 25*a*. This initialization action causes the microprocessor controller 16 to telephone the BSCU 12 to inform the BSCU 12 that the bus 19 is beginning its route and to initialize the BSCU 14 relative to the VCU 12. The foregoing action is indicated at flow chart block 45*b* (FIG. 4A). Alternatively, the bus driver can press the start/reset switch 21 on the VCU 12 to initialize the VCU 12.

After initialization of the VCU 12, the display module 33 preferably displays "Stop Number 1" followed by the amount of time to reach stop number 1. The time continuously runs as the bus 19 progresses along the bus route.

Next, as indicated at flow chart block 45*c* (FIG. 4A), the VCU 12 determines, continuously or periodically, if the bus 19 is on time by analyzing the status of devices 21–25 (FIG. 1) in view of planned route data (derived from initialization). In the preferred embodiment, the VCU 12 at least compares its elapsed time from the clock 24 (FIG. 1) with its scheduled time from the planned route data. When the bus 19 is on time, the VCU 12 does not contact the BSCU 14, and the BSCU 14 commences calling students at the predefined time prior to arrival of the bus 19 at the particular bus stop, as indicated in flow chart block 45*e* (FIG. 4A). In the example of FIG. 4B, at five minutes along the scheduled route, the BSCU 14 places a telephone call to the homes 36 of the school children to be picked up at bus stop number 1.

However, when the VCU 12 determines that the bus 19 is early or late at this juncture, the VCU 12 contacts the BSCU 14, as indicated at flow chart block 45*d* (FIG. 4A), and the BSCU 14 adjusts its student calling lists accordingly so that the students are called in accordance with the predefined time notice, e.g., five minutes.

Further, as indicated at flow chart block 45*f* (FIG. 4A), the VCU 12 again determines, continuously or periodically, if the bus 19 is on time by analyzing the devices 21–25 (FIG. 1). Preferably, in this regard, the VCU 12 at least compares its elapsed time with its scheduled time.

Back to the example of FIG. 4B, at ten minutes along the schedule, the bus 19 arrives at the bus stop number 1 and takes one minute to load all the students at this stop onto the bus 19. Just prior to leaving stop 1, the bus driver actuates the move forward switch 22. Upon actuating the move forward switch 22, the display module 33 preferably displays "Stop Number 2" followed by the amount of time to reach stop number 2. The foregoing feedback signal may be generated by one of the sensors 25*a*–25*e* so that the bus driver need not actuate the move forward switch 22.

In accordance with flow chart block 45*f* (FIG. 4A), the microprocessor controller 16 checks the elapsed time of eleven minutes to confirm that such time corresponds to the programmed time for bus stop number 1. It will determine whether the bus 19 is early or late. If the bus 19 is either early or late, the VCU 12 will call the BSCU 14 to inform the unit 14 of this fact, as indicated at flow chart blocks 45*g* and 45*h* (FIG. 4A). If the bus 19 is on time, then the VCU 12 will continue to monitor the inputs from devices 21–25, as indicated in flow chart block 45*j*. In the example of FIG. 4B, it is assumed that the bus 19 is neither early nor late in leaving bus stop number 1.

Because the bus 19 is scheduled to arrive at bus stop number 2 at sixteen minutes along the route, at eleven minutes along the route the BSCU 14 places telephone calls to the homes 36 of the school children who board the bus 19 at bus stop number 2, as indicated at flow chart block 45*k* (FIG. 4A).

The bus 19 then arrives at bus stop number 2 and commences the boarding of students. However, because one of the school children is running late that particular morning, the bus 19 spends three minutes at bus stop number 2, and, thus, gets three minutes behind schedule. Thus, the bus departs at twenty minutes along the route.

At this time, the VCU 12 makes an inquiry as to whether there are any more bus stops, as indicated in flow chart block 45*l*. If so, then the VCU 12 again monitors its travel status by checking devices 21–25 (FIG. 1), in accordance with flow chart block 45*f* (FIG. 4A). If not, then the VCU 12 notifies the BSCU 14 of the end of the route, as indicated at flow chart block 45*m*.

In the example of FIG. 4B, upon receiving the information that the bus 19 is late, the microprocessor controller 16 compares the departure time to the scheduled departure time of seventeen minutes, pursuant to flow chart block 45*f* (FIG. 4A), and determines that the bus 19 is three minutes behind schedule, in accordance with flow chart blocks 45*g* (FIG. 4A). The microprocessor controller 16 then telephones the BSCU 14 to inform the BSCU 14 that the bus 19 is three minutes behind schedule, as indicated in flow chart block 45*h* (FIG. 4A). A fleet operator's screen associated with the BSCU 14 is updated to reflect the status of the late bus 19, as indicated at flow chart block 45*i* (FIG. 4A). Moreover, as indicated at flow chart block 45*d* (FIG. 4A), the BSCU 14 then reschedules the telephone calls that are to be made to the parents of the students at bus stop number 3 from twenty-two minutes along the route to twenty-five minutes along the route and resets the VCU 12 to seventeen minutes along the route, the scheduled time for the bus to leave bus stop number 2.

At twenty minutes along the route, the BSCU 14 calls the student homes 36 of the students corresponding to bus stop number 3, in accordance with flow chart block 45*k* (FIG. 4A), to inform them that the bus 19 is five minutes from arriving. At twenty-five minutes along the route, the bus 19 arrives at bus stop 3, takes one minute to load the students on to the bus 19 and then proceeds onto the school.

At this time, the VCU 12 makes an inquiry as to whether there are any more bus stops, as indicated in flow chart block 45*l*. In the example of FIG. 4B, there are no more stops and, accordingly, the VCU 12 notifies the BSCU 14 of the end of the route, as indicated at flow chart block 45*m*.

Finally, worth noting is that the system 10 may be configured so that if a bus 19 becomes delayed by more than a maximum length of time, such as fifteen minutes, the BSCU 14 immediately calls the homes 36 of the remaining students to board the bus 19 in order to notify these homes 36 of the unusual delay and to notify these homes 36 to wait for a notification call.

III. Control Programs

Figure 6:
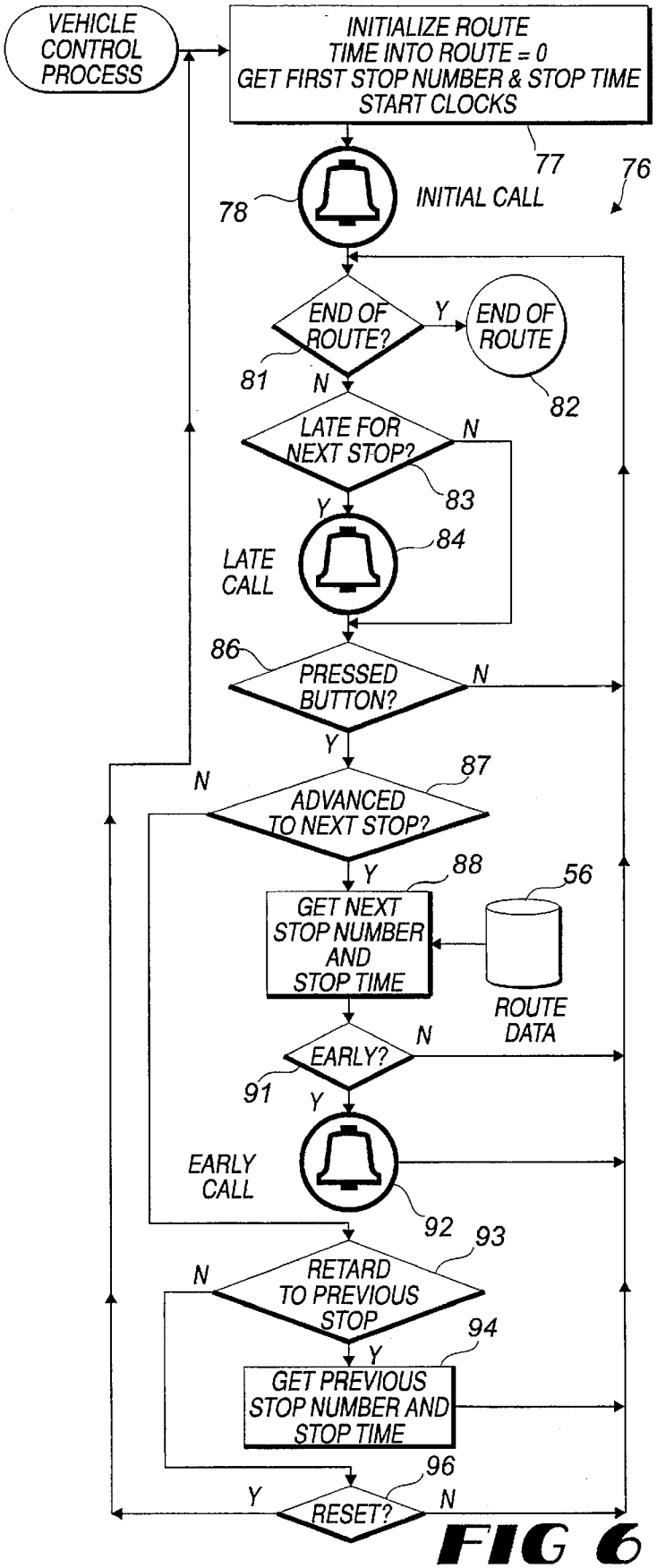
FIG. 6 is a flow chart of a vehicle control program for the VCU of FIGS. 1 and 2.
Figure 7:
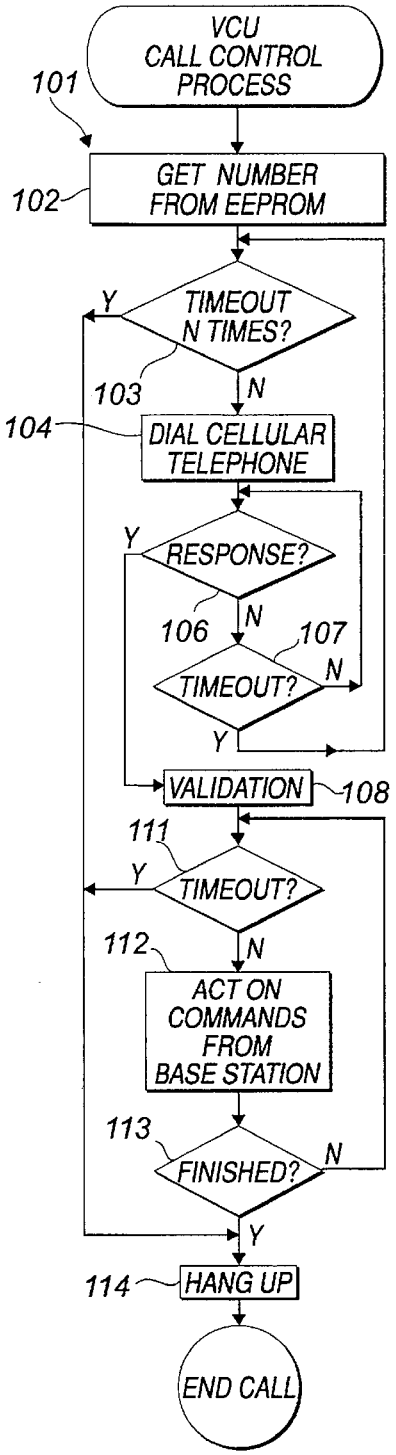
FIG. 7 is a flow chart of a VCU call control program for the VCU of FIGS. 1 and 2.

FIGS. 5 through 7 show flow charts pertaining to control programs that implement control processes or algorithms of the advance notification system 10 of FIG. 1 in order to achieve the functionality as set forth in FIGS. 4A and 4B as described hereinbefore. These flow charts illustrate the best mode for practicing the invention at the time of filing this document. More specifically, FIG. 5 illustrates a base station control program 46 employed in the BSCU 14, and FIGS. 6 and 7 show respectively a vehicle control program 76 and a VCU call control program 101 implemented in the VCU 12. The foregoing control programs implement merely examples of plausible control algorithms, and an infinite number of control algorithms may be employed to practice the present invention. Furthermore, it should be noted that the base station control program 46 of FIG. 5 is implemented via software within any conventional computer system, and the vehicle control program 76 of FIG. 6 and the VCU call control program 101 of FIG. 7 are both implemented via software run from RAM 44 (FIG. 3A) by the microprocessor controller 16. However, these control operations need not be implemented in software and could be implemented perhaps in hardware or even manually by human interaction.

A. Base Station Control Program

With reference to FIG. 5, the base station control program 46 essentially comprises two control subprograms which run concurrently, namely, (a) a vehicle communications program 47 and (b) a student calling program 48. The vehicle communications program 47 will be described immediately hereafter followed by the student calling program 48.

1. Vehicle Communications Program

The vehicle communications program 47 initially waits for a telephone call from one of the VCUs 12 located on one of the plurality of buses 19, as indicated by a flow chart block 51. The vehicle communications program 47 is preferably capable of monitoring a plurality of telephone connections 26' for receiving information from a plurality of buses 19. As the number of buses 19 is increased, the number of telephone connections 26' which are monitored by the vehicle communications program 47 should also be increased to an extent.

After the start of a bus 19 along its route, the respective VCU 12 will initiate a telephone call to the BSCU 14, as indicated by the telephone bell symbol 52. After the BSCU 14 receives the telephone call, a string of symbols is exchanged between the VCU 12 and the BSCU 14 so as to validate the communication connection, as indicated in a flow chart block 53. In other words, the BSCU 14 ensures that it is in fact communicating with the VCU 12, and vice versa.

Next, as shown in a flow chart block 54, the BSCU 14 asks the VCU 12 for information regarding (a) the time into the route and (b) the number designating the next stop. In addition, route data 56 is obtained from a local data base. The route data 56 includes information pertaining to each bus stop and how much time it should take to reach each bus stop during the route. From the route data 56 and the information (a) and (b), as indicated previously, received from the VCU 12, the BSCU 14 can determine whether the bus 19 is late or early, as indicated by flow chart blocks 57, 58, or whether the bus 19 has just started its route, as indicated by a flow chart block 59. In the case where the bus 19 is late, the BSCU 14 advises the VCU 12 to reset its on-board clock 24 back so that it thinks it is on time, as indicated in a flow chart block 61. In the case where the bus 19 is early, the BSCU 14 advises the VCU 12 to move its on-board clock 24 forward so that the VCU 12 thinks it is on time, as indicated in flow chart block 62. Moreover, in the situation where the bus 19 has just started its route and the telephone call is essentially the first call of the route, the base station clock 28 and the on-board vehicle clock 24 are synchronized, as indicated in a flow chart block 63.

Finally, as shown in a flow chart block 64, the BSCU 14 informs the VCU 12 to terminate the telephone call, which was initiated in the flow chart block 51. The vehicle communications program 47 then proceeds once again to the flow chart block 51, where it will remain until receiving another telephone call from the bus 19.

Worth noting from the foregoing discussion is the fact that the BSCU 14 is the ultimate controller of the advance notification system 10 from a hierarchical vantage point. The base station clock 28 maintains the absolute time of the advance notification system 10, while the vehicle clock 24 assumes a subservient role and is periodically reset when the bus 19 is at the start of a route or when the bus 19 is either early or late during the route. Further, it should be noted that the VCU 12 communicates to the BSCU 14 only (a) when the bus 19 is at the start of a route, (b) when the bus 19 is either early or late during the route, and (c) when the bus 19 completes its route, so as to minimize the amount of time on the mobile telephone network and associated costs thereof.

2. Student Calling Program

As previously mentioned, the student calling program 48 runs concurrently with the vehicle communications program 47 within the BSCU 14. In essence, the student calling program 48 uses the timing information retrieved from the bus 19 by the vehicle communications program 47 in order to call students and inform them of the approaching bus 19. A student list 66 is locally accessible from a local data base by the BSCU 14 and comprises information regarding (a) student names, (b) student telephone numbers, and (c) the time into a bus route when a student should be called via telephone. In accordance with the student calling program 48, as indicated in a flow chart block 67, the student list 66 is consulted as time progresses and telephone numbers are retrieved. When a particular time for calling a particular student is reached, the student calling program 48 initiates a telephone call to the particular student, as shown in flow chart blocks 68, 69. The telephone call can be made by using a distinctive telephone ring or a predefined number of rings, as described previously. Moreover, the particular time is fully selectable by programming.

Also worth noting is that the program can also include a feature for monitoring calls to be placed in the future. In accordance with this feature, upon anticipation of a heavy load of calls, some of the calls would be initiated earlier than the originally scheduled, corresponding call time.

After the bus route has been completed by the bus 19, the particular bus and bus route are removed from consideration, as indicated by flow chart blocks 71, 72. Otherwise, the student calling program 48 returns to the student list 66 and searches for the next student to be called.

As further shown in FIG. 5, an event list 73 is maintained for diagnostics and system monitoring. The event list 73 receives data from both the vehicle communications program 47 and the student calling program 46. The event list 73 essentially comprises records of, among other things, all telephone calls and all past and current bus locations.

B. Vehicle Control Program

Reference will now be made to the vehicle control program 76 shown in FIG. 6. Initially, as indicated in the flow chart block 77 of the vehicle control program 76, the VCU 12 runs through an initiation procedure in which the first stop number is retrieved, the stop time (time necessary to travel to the next stop) is retrieved, and the time into the route as indicated by the clock 24 is set at zero and the clock 24 is started. After the foregoing initialization procedure, a call is initiated via the transceiver 18 to the BSCU 14, as indicated by the bell symbol 78. After the connection, the VCU 12 and the BSCU 14 exchange information as described hereinbefore and which will be further described hereinafter relative to FIG. 7.

Next, as shown in FIG. 6, the vehicle control program 76 begins a looping operation wherein the VCU 12 continuously monitors the switches 21–23, clock 24, and sensors **25*a*–25*e*, if present, to determine whether the bus 19 is early or late. As mentioned previously, the vehicle control program 76 initiates a call only at start-up of a route, or when the bus 19 is either early or late, and not when the bus 19** is on time.

While in the main looping operation, a determination is first made as to whether the bus 19 has reached the end of the route, as indicated in a decisional flow chart block 81. If the bus 19 is at the end of its route, then the vehicle control program 76 stops, as indicated in a flow chart block 82, and does not start unless the start/reset switch 21 is triggered by the bus driver. Otherwise, the program 76 continues and makes a determination as to whether the bus 19 is late for the next stop, as indicated in a decisional flow chart block 83. In the preferred embodiment, the bus 19 is considered late if the bus 19 arrives at a stop more than a predetermined late time period, such as 50 seconds, after when it should have arrived. If the bus 19 is late, then a call is initiated to the BSCU 14, as shown by a bell symbol 84 in FIG. 7.

If the bus is not late, then the program 76 determines whether any of the switches 21, 22, 23 have been actuated, as indicated in a decisional flow chart block 86. If none of the switches 21, 22, 23 have been actuated, then the program 76 will loop back around and begin flow chart block 81 once again. Otherwise, if actuation of a switch 21, 22, 23 is detected, then the program 76 will determine which of the switches 21, 22, 23 has been actuated.

First, the program 76 will determine whether the move forward switch 22 has been actuated, as indicated in the decision flow chart block 87. If the bus driver has actuated the move forward switch 22, then the VCU 12 will retrieve the next stop number and corresponding stop time, as indicated in flow chart block 88, from a local data base having the route data 56. Moreover, a decision will be made as to whether the bus 19 is early for that particular stop, as indicated in the decision flow chart block 91. In the preferred embodiment, the bus 19 is considered early if the bus 19 arrives at a stop more than a predetermined early time period, such as 50 seconds, earlier than when it should have arrived. If the bus is not early, then the program 76 will loop back and proceed again with the flow chart block 81. Otherwise, a call will be initiated to the BSCU 14 to inform the unit 14 that the bus 19 is early, as illustrated by bell symbol 92 in FIG. 7.

In the event that the bus driver has not actuated the move forward switch 22, the program 76 proceeds to decisional flow chart block 93 wherein the program 76 determines whether the move backward switch 23 has been actuated by the bus driver. If the move backward switch 23 has been actuated, then the program 76 obtains the previous stop number and stop time, as indicated in flow chart block 94, displays these values on the display screen, and loops back to begin again with the flow chart block 81.

In the event that the bus driver has not actuated the move backward switch 23, then the program 76 determines whether the bus driver has actuated the start/reset switch 21, as indicated in the decisional flow chart block 96. If the start/reset switch 23 has not been actuated by the bus driver, then the program 76 loops back and begins again with the flow chart block 81. Otherwise, the program 76 loops back and begins again with the flow chart block 77.

C. VCU Call Control Program

When a call is initiated by the VCU 12 as indicated by the call symbols 78, 84, 92, the VCU 12 follows the VCU call control program 101 as illustrated in FIG. 7. Initially, if a mobile telephone is used by the VCU 12, the telephone number corresponding with the BSCU 14 is obtained from the EEPROM 43, as indicated in a flow chart block 102. Other information is also obtained, including among other things, the particular bus number, bus serial number, and bus route. Next, the VCU call control program 101 sets a time out variable to keep track of how many times a communication connection has been initiated. The number n of allowable attempts is predetermined and is stored in the EEPROM 43.

After the time out variable has been implemented as indicated in the flow chart block 103, the VCU call control program 101 causes the transceiver 18 to be called, as indicated in the flow chart block 104. The call control program 101 requires the VCU 12 to wait for a response from the BSCU 14. If the VCU 12 does not receive a response within a predetermined time out period, preferably 20 seconds, then the VCU call control program 101 loops back and begins again at the flow chart block 103. Otherwise, when the VCU call control program 101 determines that a response has been received, a validation procedure ensues, as indicated in a flow chart block 108. The validation process indicated at the flow chart block 108 is that which was described previously relative to the flow chart block 53 of FIG. 5. Essentially, it involves the exchange of symbols in order to assure a proper connection.

At the commencement of the validation process, another time out variable is set and will trigger termination of the telephone connection after a predetermined time period has run. The initiation of the time out variable and monitoring of the same is indicated in FIG. 7 at flow chart block 111. If the time out variable triggers termination of the telephone connection, then the VCU call control program 101 will hang up and end the call, as illustrated by a flow chart block 114. Otherwise, when the validation procedure has fully commenced, commands are passed from the BSCU 14 to the VCU 12, as shown by a flow chart block 112. Commands which may be sent to the VCU 12 include, for example, the following: (1) Is the bus 19 either early or late?; (2) Reset the vehicle clock 24; (3) Record new information in the EEPROM 43. It should be emphasized that the BSCU 14 may change the route information contained within the EEPROM 43 of the particular bus 19. The foregoing features enables extreme flexibility of the advance notification system 10.

Furthermore, the VCU call control program 101 determines whether the BSCU 14 has finished its communication over the mobile telephone, as indicated in a flow chart block 113. Again, the VCU call control program 101 utilizes another time out variable to determine whether the BSCU 14 has finished. After the predetermined time period of the time out variable, the VCU call control program 101 will assume that the BSCU 14 has terminated its communication, and accordingly, the VCU call control program 101 will hang up the telephone, as indicated in a flow chart block 114. Otherwise, the VCU call control program 101 will loop back and begin with the flow chart block 111 in order to accept another command from the BSCU 14.

IV. Management Of BSCU By A Passenger

In the preferred embodiment of the invention, a passenger of the system 10 can communicate with and manage the BSCU 14 of the system 10 through an interactive system, such as an interactive voice response system (IVR) or other suitable communication system. This interactive system provides the passenger with flexibility and control over the calling parameters and the ability to solicit information, i.e., reports. When a passenger calls into the system 10, the passenger may (a) enroll and/or make changes to the calling parameters of the BSCU 14, including defining the preset notification time period when the passenger is to receive a telephone call prior to arrival of the vehicle 29 at the stop (to thereby indicate impending arrival of the vehicle 29), (b) obtain a vehicle progress report so as to check on vehicle delays or if the passenger has missed the vehicle, and/or (c) receive a calling report on the last notification attempt.

Moreover, in accordance with a security feature of the present invention, the BSCU 14 is configured so that when a passenger requests any of the foregoing information, the telephone number of the passenger telephone 29 is checked by the BSCU 14. If a passenger's telephone service has the commercially available feature typically known as "calling line identification," the BSCU 14 compares the caller's telephone number with a previously-registered number (reference caller identification number) stored in the student list database 66 (FIG. 5). If the incoming number does not match or if the telephone connection does not provide the calling line identification, then the passenger is prompted to enter his/her telephone number to the BSCU 14. Moreover, the telephone number received by the BSCU 14 must be the one registered in the BSCU 14 for the aforementioned options to be used.

A. Call Back Feature

Initially, in the preferred embodiment, when enrollment is requested by a passenger, the BSCU 14 of the system 10 requests the passenger to enter its phone number, and the telephone number is registered. The BSCU 14 then calls the passenger back at the telephone number registered in the BSCU 14 to confirm, before the passenger can change calling parameters or solicit information from the BSCU 14.

If a subscribing passenger's telephone service has the commercially available feature typically known as "calling line identification," the BSCU 14 can recognize the directory number. In that case, the BSCU 14 will not have to call the passenger back to register, and enrollment can continue.

Likewise, once registered and if a subscribing passenger with calling line identification requests to use an option, the telephone number does not have to be entered. The interactive voice response system (IVR) can recognize the number delivered through calling line identification.

B. Subscription

The service provided by the system 10 can be started when the subscribing passenger calls into the interactive voice response system (IVR) from a telephone 29, preferably a touch-tone telephone. The subscribing passenger receives a prompt to enter his/her telephone number. The subscribing passenger hangs up, and the BSCU 14 calls the subscribing passenger back, unless calling line identification is in use as described previously.

Changes are only allowed if the telephone number derived from the calling line identification matches the BSCU registered number or if the entered telephone number matches the registered number.

An example illustrating the foregoing process follows. In the example, as well as the others that follow, the system 10 utilizes the trade name "Bus-Call," which is currently a federally registered trademark on the Principal Register at the United States Patent and Trademark Office.

Example Session

IVR: "Welcome to Bus-Call. Please enter your telephone number now."

Sub: <Keypad numbers pressed>

IVR: "The number you entered is xxx-xxxx. If this is correct, please press '1,' if not press '2'. The Bus-Call system will call you back within a couple of minutes. Thank you and please hang up now."

Sub: <Answers returned call>
IVR: "Hello, thank you for using the Bus-Call system. Please press:
'1' to start the Bus-Call service to your home;
'2' to change the notification time;
'3' for the date and time of the last change made to Bus-Call."

C. Service Inception

In the preferred embodiment, with the implementation of the IVR, the BSCU 14 provides voice prompts to guide the passenger through a telephone call when the passenger wishes to configure the BSCU 14 or retrieve information.

In the preferred configuration, voice prompts ask for the (a) bus number and the (b) stop number. These two pieces of information are usually given by the bus driver the first time the student rides the bus 29. The information can be taken from the VCU display module 33 (FIG. 3A) of the VCU 12 and/or written on a marketing brochure in which the student takes home.

Information can be entered into the BSCU 14 and retrieved from the BSCU 14, after the bus number and stop number are confirmed, as the BSCU 14 will provide an appropriate options menu to the caller. An example illustrating the foregoing process follows.

Example Session

Sub: <The subscribing passenger calls in and enters the appropriate option to start Bus-Call service>
IVR: "Please enter your bus number now."
Sub: <Keypad number pressed>
IVR: "The number you entered is xx. If this is correct please press '1.' If this number is incorrect please press '2.'"
Sub: <Keypad number pressed>
IVR: "Please enter your bus stop number now."
Sub: <Keypad number pressed>
IVR: "The number you entered is xx. If this is correct please press '1.' If this number is incorrect, please press '2.'"
Sub: <Keypad number pressed>

D. Preset Notification Time Period

The preset notification time period mechanism 9 (FIG. 3B) permits the passenger to define a preset notification time period when the passenger is to receive a telephone call prior to arrival of a vehicle 19 at a vehicle stop to thereby indicate impending arrival of the vehicle 19 at the stop. The preset notification time period can be provided by the passenger to BSCU 14 by depressing touch tone buttons on the passenger telephone 29 or other telephone.

If the period is not prescribed by the passenger, the default for the notification time period is set to any suitable period, such as five minutes. Moreover, the passenger prescribed time period or the default time period is announced to the passenger. Finally, if a change of the preset notification time period is needed, the passenger is prompted through the process. An example of the foregoing methodology is set forth hereafter.

| Example Session | |
|---|---|
| Sub: | <The subscribing passenger calls in and enters the appropriate option to start Bus-Call service> |
| IVR: | "Please enter your bus number now." |

-continued

| Example Session | |
|---|---|
| Sub: | <Keypad number pressed> |
| IVR: | "The number you entered is xx. If this is correct please press '1.' If this number is incorrect please press '2.'" |
| Sub: | <Keypad number pressed> |
| IVR: | "Please enter your bus stop number now." |
| Sub: | <Keypad number pressed> |
| IVR: | The number you entered is xx. If this is correct please press '1.' If this number is incorrect, please press '2.'" |
| Sub: | <Keypad number pressed> |
| IVR: | Bus-Call will ring your telephone five minutes before the bus arrives. If five minutes is not enough time, press '1.' If five minutes is OK press '2.'" |
| Sub: | <Keypad number pressed> |
| IVR: | "Thank you"<br>or<br>"Please enter the new notification time now."<br><Keypad number pressed><br>"The time you entered is xx minutes. If this is correct, press '1.' If this number is incorrect, press '2.'<br><Keypad number pressed><br>"Thank you." |

D. Vehicle Progress Report

The vehicle progress report generator 13 (FIG. 3B) in the BSCU 14 allows a subscribing passenger to solicit information from the BSCU 14 pertaining to the progress of the vehicle 29 relative to its route and/or relative to a particular stop. A subscribing passenger may feel that the vehicle 29 was missed. By calling the BSCU 14 and pressing the appropriate option, the IVR provides information about the current vehicle location.

| Example Session | |
|---|---|
| IVR: | "Press (3) if you think you have missed the bus." |
| Sub: | <Keypad (3) pressed> |
| IVR: | "Please enter your telephone number now." |
| Sub: | <Keypad numbers pressed> |
| IVR: | "The bus has . . . "<br>" . . . Already passed your stop. The Bus-Call system called your telephone number at 7:27 a.m. and received a busy signal. The bus stopped at 7:32 a.m."<br>or<br>" . . . Has not arrived and is approaching your stop in approximately 12 minutes." |

E. Calling Report

The calling report generator 11 (FIG. 3B) in the BSCU 14 allows a subscribing passenger to solicit a calling report from the BSCU 14. The calling report can indicate, among other things, the time(s) and outcome(s) of any previous notification attempt(s) by the BSCU 14 to the passenger telephone 29. The BSCU 14 can be programmed to make any number of attempts, but preferably, the BSCU 14 makes three attempts to provide notification.

| Example Session | |
|---|---|
| IVR: | "Press (4) if you would like a report on the last notification attempt." |

-continued

| Example Session | |
|---|---|
| Sub: | <keypad (4) pressed> |
| IVR: | "Please enter your telephone number now." |
| Sub: | <Keypad numbers pressed> |
| IVR: | "The Bus-Call system called your telephone number at 7:15 a.m. on Monday, February 20 . . . "<br>" . . . The call was answered."<br>or<br>" . . . The telephone was busy."<br>or<br>" . . . The telephone rang but was not answered."<br>or<br>" . . . The telephone number was not in service or called block was engaged." |

This calling report generator 11 can also be configured to allow the subscribing passenger to check on the last changes made to the calling parameters. In this configuration, the IVR gives the change made and the date the change was requested by the subscribing passenger.

It will be obvious to those skilled in the art that many modifications may be made to the preferred embodiment of the present invention, as set forth above, without departing substantially from the principles of the present invention. All such modifications are intended to be included herein within the scope of the present invention, as defined in the following claims.

Wherefore, the following is claimed:

1. A method for an advance notification system that notifies a user of an impending arrival of a vehicle at a vehicle stop, the system comprising (a) a user telephone interface, (b) a system telephone interface, and (c) a system control for monitoring travel of said vehicle in relation to the vehicle step and for initiating a telephone call with said system telephone interface to the user telephone interface before the vehicle reaches the vehicle stop to thereby indicate impending arrival of the vehicle at the vehicle stop, the method comprising the steps of:

(a) permitting said user telephone interface to solicit a report corresponding to a previous telephone call made by said system telephone interface to said user telephone interface including the following steps:

(1) permitting establishment of a telephone communication link between said user telephone interface and said system telephone interface;

(2) providing said report from said system control to said user telephone interface during said telephone communication link; and (3) indicating in said report whether said user telephone interface was busy when said system telephone interface initiated said previous telephone call to said user telephone interface.

2. The method of claim 1, further comprising the step of indicating in said report whether said user telephone interface was answered when said system telephone interface initiated said previous telephone call to said user telephone interface.

3. The method of claim 1, further comprising the step of indicating in said report whether said user telephone interface was not answered when said system telephone interface initiated said previous telephone call to said use, telephone interface.

4. The method of claim 1, further comprising the step of indicating in said report whether said user telephone interface was out of service when said system telephone interface initiated said previous telephone call to said user telephone interface.

5. The method of claim 1, further comprising the step of indicating in said report a time when said previous telephone call was initiated by said system telephone interface to said user telephone interface.

6. The method of claim 1, further comprising the steps of:

maintaining a reference caller identification number associated with said user telephone interface; and when said telephone communication link is established, determining whether said telephone communication link is authorized by comparing a caller identification number associated with said telephone communication link with a reference caller identification.

7. A method for an advance notification system that notifies a user of an impending arrival of a vehicle at a vehicle stop, the system comprising (a) a user telephone interface, (b) a system telephone interface, and (c) a system control for monitoring travel of said vehicle in relation to the vehicle stop and for initiating a telephone call with said system telephone interface to the user telephone interface before the vehicle reaches the vehicle stop to thereby indicate impending arrival of the vehicle at the vehicle stop, the method comprising the steps of:

(a) permitting said user telephone interface to solicit a report corresponding to a previous telephone call made by said system telephone interface to said user telephone interface including the following steps:

(1) permitting establishment of a telephone communication link between said user telephone interface and said system telephone interface;

(2) providing said report from said system control to said user telephone interface during said telephone communication link; and (3) indicating in said report whether said user telephone interface was answered when said system telephone interface initiated said previous telephone call to said user telephone interface.

8. The method of claim 7, further comprising the step of indicating in said report whether said user telephone interface was not answered when said system telephone interface initiated said previous telephone call to said user telephone interface.

9. The method of claim 7, further comprising the step of indicating in said report whether said user telephone interface was out of service when said system telephone interface initiated said previous telephone call to said user telephone interface.

10. The method of claim 7, further comprising the step of indicating in said report a time when said previous telephone call was initiated by said system telephone interface to said user telephone interface.

11. The method of claim 7, further comprising the steps of:

maintaining a reference caller identification number associated with said user telephone interface; and when said telephone communication link is established, determining whether said telephone communication link is authorized by comparing a caller identification number associated with said telephone communication link with a reference caller identification.

12. A method for an advance notification system that notifies a user of an impending arrival of a vehicle at a vehicle stop, the system comprising (a) a user telephone interface, (b) a system telephone interface, and (c) a system control for monitoring travel of said vehicle in relation to the vehicle stop and for initiating a telephone call with said system telephone interface to the user telephone interface before the vehicle reaches the vehicle stop to thereby indicate impending arrival of the vehicle at the vehicle stop, the method comprising the steps of:

(a) permitting said user telephone interface to solicit a report corresponding to a previous telephone call made by said system telephone interface to said user telephone interface including the following steps:

(1) permitting establishment of a telephone communication link between said user telephone interface and said system telephone interface;

(2) providing said report from said system control to said user telephone interface during said telephone communication link; and (3) indicating in said report whether said user telephone interface was not answered when said system telephone interface initiated said previous telephone call to said user telephone interface.

13. The method of claim 12, further comprising the step of indicating in said report whether said user telephone interface was out of service when said system telephone interface initiated said previous telephone call to said user telephone interface.

14. The method of claim 12, further comprising the step of indicating in said report a time when said previous telephone call was initiated by said system telephone interface to said user telephone interface.

15. The method of claim 12, further comprising the steps of:

maintaining a reference caller identification number associated with said user telephone interface; and when said telephone communication link is established, determining whether said telephone communication link is authorized by comparing a caller identification number associated with said telephone communication link with a reference caller identification.

16. A method for an advance notification system that notifies a user of an impending arrival of a vehicle at a vehicle stop, the system comprising (a) a user telephone interface associated with said user, (b) a system telephone interface, and (c) a system control for monitoring travel of said vehicle in relation to the vehicle stop and for initiating a telephone call with said system telephone interface to the user telephone interface before the vehicle reaches the vehicle stop to thereby indicate impending arrival of the vehicle at the vehicle stop, the method comprising the steps of:

(a) permitting said user telephone interface to solicit a report corresponding to a previous telephone call made by said system telephone interface to said user telephone interface including the following steps:

(1) permitting establishment of a telephone communication link between said user telephone interface and said system telephone interface;

(2) providing said report from said system control to said user telephone interface during said telephone communication link; and (3) indicating in said report whether said user telephone interface was out of service when said system telephone interface initiated said previous telephone call to said user telephone interface.

17. The method of claim 16, further comprising the step of indicating in said report a time when said previous telephone call was initiated by said system telephone interface to said user telephone interface.

18. The method of claim 16, further comprising the steps of:

maintaining a reference caller identification number associated with said user telephone interface; and when said telephone communication link is established, determining whether said telephone communication link is authorized by comparing a caller identification number associated with said telephone communication link with a reference caller identification.

19. A method for an advance notification system that notifies a user of an impending arrival of a vehicle at a vehicle stop, the system comprising (a) a user telephone interface associated with said user, (b) a system telephone interface, and (c) a system control for monitoring travel of said vehicle in relation to the vehicle stop and for initiating a telephone call with said system telephone interface to the user telephone interface before the vehicle reaches the vehicle stop to thereby indicate impending arrival of the vehicle at the vehicle stop, the method comprising the steps of:

(a) permitting said user telephone interface to solicit a report corresponding to a previous telephone call made by said system telephone interface to said user telephone interface including the following steps:

(1) permitting establishment of a telephone communication link between said user telephone interface and said system telephone interface;

(2) providing said report from said system control to said user telephone interface during said telephone communication link; and (3) indicating in said report a time when said previous telephone call was initiated by said system telephone interface to said user telephone interface.

20. The method of claim 19, further comprising the steps of:

maintaining a reference caller identification number associated with said user telephone interface; and when said telephone communication link is established, determining whether said telephone communication link is authorized by comparing a caller identification number associated with said telephone communication link with a reference caller identification.

21. A method for an advance notification system that notifies a user of an impending arrival of a vehicle at a vehicle stop, the method for permitting the user to solicit a report corresponding to a previous telephone call made by the system to the user, wherein the system comprises (a) a user telephone interface associated with said user; (b) a vehicle control unit disposed on said vehicle, said vehicle control unit having: (1) a vehicle travel monitoring means; (2) a vehicle transmitter adapted to transmit a travel signal based upon said vehicle travel monitoring means; (3) a vehicle processor controlling said vehicle travel monitoring means and said vehicle transmitter; and (c) a base station control unit having: (1) a receiver adapted to receive said travel signal from said vehicle control unit; (2) a base station telephone interface; (3) a base station processor controlling said receiver and said base station telephone, said base station processor for establishing a telephone connection between said base station telephone interface and said user telephone interface when said vehicle is at said preset time from said vehicle stop; and wherein the method comprises the steps of:

(a) permitting said user telephone interface to solicit said report corresponding to said previous telephone call made by said base station telephone interface to said user telephone interface by the following steps:

(1) establishing a telephone communication link between said user telephone interface and said base station telephone interface;

(2) providing said report from said system control to said user telephone interface during said telephone communication link; and (3) indicating in said report that said user telephone interface was busy when said base station telephone interface initiated said previous telephone call to said user telephone interface.

22. The method of claim 21, further comprising the step of indicating in said report whether said user telephone interface was answered when said base station telephone interface initiated said previous telephone call to said user telephone.

23. The method of claim 21, further comprising the step of indicating in said report whether said user telephone interface was not answered when said base station telephone interface initiated said previous telephone call to said user telephone interface.

24. The method of claim 21, further comprising the step of indicating in said report whether said user telephone interface was out of service when said base station telephone interface initiated said previous telephone call to said user telephone interface.

25. The method of claim 21, further comprising the step of indicating in said report a time when said previous telephone call was initiated by said base station telephone interface to said user telephone interface.

26. The method of claim 21, further comprising the steps of:

maintaining a reference caller identification number associated with said user telephone interface; and when said telephone communication link is established, determining whether said telephone communication link is authorized by comparing a caller identification number associated with said telephone communication link with a reference caller identification.

27. A method for an advance notification system that notifies a user of an impending arrival of a vehicle at a vehicle stop, the method for permitting the user to solicit a report corresponding to a previous telephone call made by the system to the user, wherein the system comprises (a) a user telephone interface associated with said user; (b) a vehicle control unit disposed on said vehicle, said vehicle control unit having: (1) a vehicle travel monitoring means; (2) a vehicle transmitter adapted to transmit a travel signal based upon said vehicle travel monitoring means; (3) a vehicle processor controlling said vehicle travel monitoring means and said vehicle transmitter; and (c) a base station control unit having: (1) a receiver adapted to receive said travel signal from said vehicle control unit; (2) a base station telephone interface; (3) a base station processor controlling said receiver and said base station telephone, said base station processor for establishing a telephone connection between said base station telephone interface and said user telephone interface when said vehicle is at said preset time from said vehicle stop; and wherein the method comprises the steps of:

(a) permitting said user telephone interface to solicit said report corresponding to said previous telephone call made by said base station telephone interface to said user telephone interface by the following steps:

(1) permitting establishment of a telephone communication link between said user telephone interface and said base station telephone interface;

(2) providing said report from said system control to said user telephone interface during said telephone communication link; and (3) indicating in said report whether said user telephone interface was answered when said base station telephone interface initiated said previous telephone call to said user telephone interface.

28. The method of claim 27, further comprising the step of indicating in said report whether said user telephone interface was not answered when said base station telephone interface initiated said previous telephone call to said user telephone interface.

29. The method of claim 27, further comprising the step of indicating in said report whether said user telephone interface was out of service when said base station telephone interface initiated said previous telephone call to said user telephone interface.

30. The method of claim 27, further comprising the step of indicating in said report a time when said previous telephone call was initiated by said base station telephone interface to said user telephone interface.

31. The method of claim 27, further comprising the steps of:

maintaining a reference caller identification number associated with said user telephone interface; and when said telephone communication link is established, determining whether said telephone communication link is authorized by comparing a caller identification number associated with said telephone communication link with a reference caller identification.

32. A method for an advance notification system that notifies a user of an impending arrival of a vehicle at a vehicle stop, the method for permitting the user to solicit a report corresponding to a previous telephone call made by the system to the user, wherein the system comprises: (a) a user telephone interface associated with said user; (b) a vehicle control unit disposed on said vehicle, said vehicle control unit having: (1) a vehicle travel monitoring means; (2) a vehicle transmitter adapted to transmit a travel signal based upon said vehicle travel monitoring means; (3) a vehicle processor controlling said vehicle travel monitoring means and said vehicle transmitter; and (c) a base station control unit having: (1) a receiver adapted to receive said travel signal from said vehicle control unit; (2) a base station telephone interface; (3) a base station processor controlling said receiver and said base station telephone, said base station processor for establishing a telephone connection between said base station telephone interface and said user telephone interface when said vehicle is at said preset time from said vehicle stop; and wherein the method comprises the steps of:

(a) permitting said user telephone interface to solicit said report corresponding to said previous telephone call made by said base station telephone interface to said user telephone interface by the following steps:

(1) permitting establishment of a telephone communication link between said user telephone interface and said base station telephone interface;

(2) providing said report from said system control to said user telephone interface during said telephone communication link; and (3) indicating in said report whether said user telephone interface was not answered when said base station telephone interface initiated said previous telephone call to said user telephone interface.

33. The method of claim 32, further comprising the step of indicating in said report whether said user telephone interface was out of service when said base station telephone interface initiated said previous telephone call to said user telephone interface.

34. The method of claim 32, further comprising the step of indicating in said report a time when said previous telephone call was initiated by said base station telephone interface to said user telephone interface.

35. The method of claim 32, further comprising the steps of:

maintaining a reference caller identification number associated with said user telephone interface; and when said telephone communication link is established, determining whether said telephone communication link is authorized by comparing a caller identification number associated with said telephone communication link with a reference caller identification.

36. A method for an advance notification system that notifies a user of an impending arrival of a vehicle at a vehicle stop, the method for permitting the user to solicit a report corresponding to a previous telephone call made by the system to the user, wherein the system comprises (a) a user telephone interface associated with said user; (b) a vehicle control unit disposed on said vehicle, said vehicle control unit having: (1) a vehicle travel monitoring means; (2) a vehicle transmitter adapted to transmit a travel signal based upon said vehicle travel monitoring means; (3) a vehicle processor controlling said vehicle travel monitoring means and said vehicle transmitter; and (c) a base station control unit having: (1) a receiver adapted to receive said travel signal from said vehicle control unit; (2) a base station telephone interface; (3) a base station processor controlling said receiver and said base station telephone, said base station processor for establishing a telephone connection between said base station telephone interface and said user telephone interface when said vehicle is at said preset time from said vehicle stop; and wherein the method comprises the steps of:

(a) permitting said user telephone interface to solicit said report corresponding to said previous telephone call made by said base station telephone interface to said user telephone interface by the following steps:

(1) permitting establishment of a telephone communication link between said user telephone interface and said base station telephone interface;

(2) providing said report from said system control to said user telephone interface during said telephone communication link; and (3) indicating in said report whether said user telephone interface was out of service when said base station telephone interface initiated said previous telephone call to said user telephone interface.

37. The method of claim 36, further comprising the step of indicating in said report a time when said previous telephone call was initiated by said base station telephone interface to said user telephone interface.

38. The method of claim 36, further comprising the steps of:

maintaining a reference caller identification number associated with said user telephone interface; and when said telephone communication link is established, determining whether said telephone communication link is authorized by comparing a caller identification number associated with said telephone communication link with a reference caller identification.

39. A method for an advance notification system that notifies a passenger of an impending arrival of a vehicle at a vehicle stop, the method for permitting the passenger to solicit a report corresponding to a previous telephone call made by the system to the passenger, wherein the system comprises: (a) a passenger telephone associated with said passenger; (b) a vehicle control unit disposed on said vehicle, said vehicle control unit having: (1) a vehicle travel monitoring means; (2) a vehicle transmitter adapted to transmit a travel signal based upon said vehicle travel monitoring means; (3) a vehicle processor controlling said vehicle travel monitoring means and said vehicle transmitter; and (c) a base station control unit having: (1) a receiver adapted to receive said travel signal from said vehicle control unit; (2) a base station telephone interface; (3) a base station processor controlling said receiver and said base station telephone, said base station processor for establishing a telephone connection between said base station telephone surface and said passenger telephone when said vehicle is at said preset lime from said vehicle stop; and wherein the method comprises the steps of:

(a) permitting said passenger to solicit said report corresponding to said previous telephone call made by said base station telephone interface to said passenger telephone by the following steps:

(1) establishing a telephone communication link between said passenger and said base station telephone interface;

(2) providing said report from said system control to said passenger during said telephone communication link; and (3) indicating in said report a time when said previous telephone call was initiated by said base station telephone interface to said passenger telephone.

40. The method of claim 39, further comprising the steps of:

maintaining a reference caller identification number associated with said passenger telephone; and when said telephone communication link is established, determining whether said telephone communication link is authorized by comparing a caller identification number associated with said telephone communication link with a reference caller identification.

41. An advance notification system for notifying a user of an impending arrival of a vehicle at a vehicle stop and for permitting the user to solicit a report corresponding to a previous telephone call made by the system to the user, comprising:

a user telephone interface associated with said user;

a, system control for monitoring travel of said vehicle in relation to the vehicle stop;

a system telephone interface in communication with said system control, said system telephone interface for establishing a telephone connection with said user telephone interface at a time before said vehicle reaches said vehicle stop; and report generator associated with said system control for generating and providing said report to said user telephone interface during a telephone communication link between said user telephone interface and said system telephone interface, said report generator having a means for indicating in said report when said user telephone interface was busy when said system telephone interface initiated said previous telephone call to said user telephone interface.

42. The system of claim 41, wherein said report generator further comprises a means for indicating in said report that said user telephone interface was answered when said system telephone interface initiated said previous telephone call to said user telephone interface.

43. The system of claim 41, wherein said report generator further comprises a means for indicating in said report that said user telephone interface was not answered when said system telephone interface initiated said previous telephone call to said user telephone interface.

44. The system of claim 41, wherein said report generator further comprises a means for indicating in said report that said user telephone interface was out of service when said system telephone interface initiated said previous telephone call to said user telephone interface.

45. The system of claim 41, wherein said report generator further comprises the step of indicating in said report a time when said previous telephone call was initiated by said system telephone interface to said user telephone interface.

46. The system of claim 41, wherein said system control further comprises:

a means for maintaining a reference caller identification number associated with said user telephone interface; and a means for, when said telephone communication link is established, determining whether said telephone communication link is authorized by comparing a caller identification number associated with said telephone communication link with a reference caller identification.

47. An advance notification system for notifying a user of an impending arrival of a vehicle at a vehicle stop and for permitting the user to solicit a report corresponding to a previous telephone call made by the system to the user, comprising:

a user telephone interface associated with said user;

a system control for monitoring travel of said vehicle in relation to the vehicle stop;

a system telephone interface in communication with said system control, said system telephone interface for establishing a telephone connection with said user telephone interface at a time before said vehicle reaches said vehicle stop; and report generator associated with said system control for generating and providing said report to said user telephone interface during a telephone communication link between said user telephone interface and said system telephone interface, said report generator having a means for indicating in said report whether said user telephone interface was answered when said system telephone interface initiated said previous telephone call to said user telephone interface.

48. The system of claim 47, wherein said report generator further comprises a means for indicating in said report whether said user telephone interface was not answered when said system telephone interface initiated said previous telephone call to said user telephone interface.

49. The system of claim 47, wherein said report generator further comprises a means for indicating in said report whether said user telephone interface was out of service when said system telephone interface initiated said previous telephone call to said user telephone interface.

50. The system of claim 47, wherein said report generator further comprises the step of indicating in said report a time when said previous telephone call was initiated by said system telephone interface to said user telephone interface.

51. The system of claim 47, wherein said system control further comprises:

a means for maintaining a reference caller identification number associated with said user telephone interface; and a means for, when said telephone communication link is established, determining whether said telephone communication link is authorized by comparing a caller identification number associated with said telephone communication link with a reference caller identification.

52. An advance notification system for notifying a user of an impending arrival of a vehicle at a vehicle stop and for permitting the user to solicit a report corresponding to a previous telephone call made by the system to the user, comprising:

a user telephone interface associated with said user;

a system control for monitoring travel of said vehicle in relation to the vehicle stop;

a system telephone interface in communication with said system control, said system telephone interface for establishing a telephone connection with said user telephone interface at a time before said vehicle reaches said vehicle stop; and report generator associated with said system control for generating and providing said report to said user telephone interface during a telephone communication link between said user telephone interface and said system telephone interface, said report generator having a means for indicating in said report whether said user telephone interface was not answered when said system telephone interface initiated said previous telephone call to said user telephone interface.

53. The system of claim 52, wherein said report generator further comprises a means for indicating in said report whether said user telephone interface was out of service when said system telephone interface initiated said previous telephone call to said user telephone interface.

54. The system of claim 52, wherein said report generator further comprises the step of indicating in said report a time when said previous telephone call was initiated by said system telephone interface to said user telephone interface.

55. The system of claim 52, wherein said system control further comprises:

a means for maintaining a reference caller identification number associated with said user telephone interface; and a means for, when said telephone communication link is established, determining whether said telephone communication link is authorized by comparing a caller identification number associated with said telephone communication link with a reference caller identification.

56. An advance notification system for notifying a user of an impending arrival of a vehicle at a vehicle stop and for permitting the user to solicit a report corresponding to a previous telephone call made by the system to the user, comprising:

a user telephone interface associated with said user;

a system control for monitoring travel of said vehicle in relation to the vehicle stop;

a system telephone interface in communication with said system control, said system telephone interface for establishing a telephone connection with said user telephone interface at a time before said vehicle reaches said vehicle stop; and report generator associated with said system control for generating and providing said report to said user telephone interface during a telephone communication link between said user telephone interface and said system telephone interface, said report generator having a means for indicating in said report whether said user telephone interface was out of service when said system telephone interface initiated said previous telephone call to said user telephone interface.

57. The system of claim 56, wherein said report generator further comprises the step of indicating in said report a time when said previous telephone call was initiated by said system telephone interface to said user telephone interface.

58. The system of claim 56, wherein said system control further comprises:

a means for maintaining a reference caller identification number associated with said user telephone interface; and a means for, when said telephone communication link is established, determining whether said telephone communication link is authorized by comparing a caller identification number associated with said telephone communication link with a reference caller identification.

59. An advance notification system for notifying a user of an impending arrival of a vehicle at a vehicle stop and for permitting the user to solicit a report corresponding to a previous telephone call made by the system to the user, comprising:

a user telephone interface associated with said user;

a system control for monitoring travel of said vehicle in relation to the vehicle stop;

a system telephone interface in communication with said system control, said system telephone interface for establishing a telephone connection with said user telephone interface at a time before said vehicle reaches said vehicle stop; and report generator associated with said system control for generating and providing said report to said user telephone interface during a telephone communication link between said user telephone interface and said system telephone interface, said report generator having a means for indicating in said report a time when said previous telephone call was initiated by said system telephone interface to said user telephone interface.

60. The system of claim 59, wherein said system control further comprises:

a means for maintaining a reference caller identification number associated with said user telephone interface; and a means for, when said telephone communication link is established, determining whether said telephone communication link is authorized by comparing a caller identification number associated with said telephone communication link with a reference caller identification.

61. An advance notification system for notifying a user of an impending arrival of a vehicle at a vehicle stop and for permitting a user to solicit a report corresponding to a previous telephone call made by the system to the user, comprising:

(a) a user telephone surface associated with said user;

(b) a vehicle control unit disposed on said vehicle, said vehicle control unit having:

(1) a vehicle travel monitoring means;

(2) a vehicle transmitter adapted to transmit a travel signal based upon said vehicle travel monitoring means;

(3) a vehicle control means controlling said vehicle travel monitoring means and said vehicle transmitter; and (c) a base station control unit having:

(1) a receiver adapted to receive said travel signal from said vehicle control unit;

(2) a base station telephone interface;

(3) a base station control controlling said receiver and said base station telephone, said base station control means for establishing a telephone connection between said base station telephone interface and said user telephone interface before said vehicle reaches said vehicle stop; and (4) a report generator associated with said base station control for generating and providing said report of said previous telephone call to said user during a telephone communication link between said user telephone interface and said base station telephone interface, said report generator having a means for indicating in said report whether said user telephone interface was busy when said base station telephone interface initiated said previous telephone call to said user telephone interface.

62. The system of claim 61, wherein said report generator further comprises a means for indicating in said report whether said user telephone interface was answered when said base station telephone interface initiated said previous telephone call to said user telephone interface.

63. The system of claim 61, wherein said report generator further comprises a means for indicating in said report whether said user telephone interface was not answered when said base station telephone interface initiated said previous telephone call to said user telephone interface.

64. The system of claim 61, wherein said report generator further comprises a means for indicating in said report whether said user telephone interface was out of service when said base station telephone interface initiated said previous telephone call to said user telephone interface.

65. The system of claim 61, wherein said report generator further comprises the step of indicating in said report a time when said previous telephone call was initiated by said base station telephone interface to said user telephone interface.

66. The system of claim 61, wherein said system control further comprises:

a means for maintaining a reference caller identification number associated with said user telephone interface; and a means for, when said telephone communication link is established, determining whether said telephone communication link is authorized by comparing a caller identification number associated with said telephone communication link with a reference caller identification.

67. An advance notification system for notifying a user of an impending arrival of a vehicle at a vehicle stop and for permitting a user to solicit a report corresponding to a previous telephone call made by the system to the user, comprising:

(a) a user telephone interface associated with said user;

(b) a vehicle control unit disposed on said vehicle, said vehicle control unit having:

(1) a vehicle travel monitoring means;

(2) a vehicle transmitter adapted to transmit a travel signal based upon said vehicle travel monitoring means;

(3) a vehicle control means controlling said vehicle travel monitoring means and said vehicle transmitter; and (c) a base station control unit having:

(1) a receiver adapted to receive said travel signal from said vehicle control unit;

(2) a base station telephone interface;

(3) a base station control controlling said receiver and said base station telephone, said base station control means for establishing a telephone connection between said base station telephone interface and said user telephone interface before said vehicle reaches said vehicle stop; and (4) a report generator associated with said base station control for generating and providing said report of said previous telephone call to said user telephone interface during a telephone communication link between said user telephone interface and said base station telephone interface, said report generator having a means for indicating in said report whether said user telephone interface was answered when said base station telephone interface initiated said previous telephone call to said user telephone interface.

68. The system of claim 67, wherein said report generator further comprises a means for indicating in said report whether said user telephone interface was not answered when said base station telephone interface initiated said previous telephone call to said user telephone interface.

69. The system of claim 67, wherein said report generator further comprises a means for indicating in said report whether said user telephone interface was out of service when said base station telephone interface initiated said previous telephone call to said user telephone interface.

70. The system of claim 67, wherein said report generator further comprises the step of indicating in said report a time when said previous telephone call was initiated by said base station telephone interface to said user telephone interface.

71. The system of claim 67, wherein said system control further comprises:

a means for maintaining a reference caller identification number associated with said user telephone interface; and a means for, when said telephone communication link is established, determining whether said telephone communication link is authorized by comparing a caller identification number associated with said telephone communication link with a reference caller identification.

72. An advance notification system for notifying a user of an impending arrival of a vehicle at a vehicle stop and for permitting a user to solicit a report corresponding to a previous telephone call made by the system to the user, comprising:

(a) a user telephone interface;

(b) a vehicle control unit disposed on said vehicle, said vehicle control unit having:

(1) a vehicle travel monitoring means;

(2) a vehicle transmitter adapted to transmit a travel signal based upon said vehicle travel monitoring means;

(3) a vehicle control means controlling said vehicle travel monitoring means and said vehicle transmitter; and (c) a base station control unit having:

(1) a receiver adapted to receive said travel signal from said vehicle control unit;

(2) a base station telephone interface;

(3) a base station control controlling said receiver and said base station telephone, said base station control means for establishing a telephone connection between said base station telephone interface and said user telephone interface before said vehicle reaches said vehicle stop; and (4) a report generator associated with said base station control for generating and providing said report of said previous telephone call to said user telephone interface during a telephone communication link between said user telephone interface and said base station telephone interface, said report generator having a means for indicating in said report whether said user telephone interface was not answered when said base station telephone interface initiated said previous telephone call to said user telephone interface.

73. The system of claim 72, wherein said report generator further comprises a means for indicating in said report whether said user telephone interface was out of service when said base station telephone interface initiated said previous telephone call to said user telephone interface.

74. The system of claim 72, wherein said report generator further comprises the step of indicating in said report a time when said previous telephone call was initiated by said base station telephone interface to said user telephone interface.

75. The system of claim 72, wherein said system control further comprises:

a means for maintaining a reference caller identification number associated with said user telephone interface; and a means for, when said telephone communication link is established, determining whether said telephone communication link is authorized by comparing a caller identification number associated with said telephone communication link with a reference caller identification.

76. An advance notification system for notifying a user of an impending arrival of a vehicle at a vehicle stop and for permitting a user to solicit a report corresponding to a previous telephone call made by the system to the user, comprising:

(a) a user telephone interface associated with said user;

(b) a vehicle control unit disposed on said vehicle, said vehicle control unit having:

(1) a vehicle travel monitoring means;

(2) a vehicle transmitter adapted to transmit a travel signal based upon said vehicle travel monitoring means;

(3) a vehicle control means controlling said vehicle travel monitoring means and said vehicle transmitter; and (c) a base station control unit having:

(1) a receiver adapted to receive said travel signal from said vehicle control unit;

(2) a base station telephone interface;

(3) a base station control controlling said receiver and said base station telephone, said base station control means for establishing a telephone connection between said base station telephone interface and said user telephone interface before said vehicle reaches said vehicle stop; and (4) a report generator associated with said base station control for generating and providing said report of said previous telephone call to said user telephone interface during a telephone communication link between said user telephone interface and said base station telephone interface, said report generator having a means for indicating in said report whether said user telephone interface was out of service when said base station telephone interface initiated said previous telephone call to said user telephone interface.

77. The system of claim 76, wherein said report generator further comprises the step of indicating in said report a time when said previous telephone call was initiated by said base station telephone interface to said user telephone interface.

78. The system of claim 77, wherein said system control further comprises:

a means for maintaining a reference caller identification number associated with said user telephone interface; and a means for, when said telephone communication link is established determining whether said telephone communication link is authorized by comparing a caller identification number associated with said telephone communication link with a reference caller identification.

79. An advance notification system for notifying a user of an impending arrival of a vehicle at a vehicle stop and for permitting a user to solicit a report corresponding to a previous telephone call made by the system to the user, comprising:

(a) a user telephone interface associated with said user;

(b) a vehicle control unit disposed on said vehicle, said vehicle control unit having:

(1) a vehicle travel monitoring means;

(2) a vehicle transmitter adapted to transmit a travel signal based upon said vehicle travel monitoring means;

(3) a vehicle control means controlling said vehicle travel monitoring means and said vehicle transmitter; and (c) a base station control unit having:

(1) a receiver adapted to receive said travel signal from said vehicle control unit;

(2) a base station telephone interface;

(3) a base station control controlling said receiver and said base station telephone, said base station control means for establishing a telephone connection between said base station telephone interface and said user telephone interface before said vehicle reaches said vehicle stop; and (4) a report generator associated with said base station control for generating and providing said report of said previous telephone call to said user telephone interface during a telephone communication link between said user telephone interface and said base station telephone interface, said report generator having means for indicating in said report a time when said previous telephone call was initiated by said base station telephone interface to said user telephone interface.

80. The system of claim 79, wherein said system control further comprises:

a means for maintaining a reference caller identification number associated with said user telephone interface; and a means for, when said telephone communication link is established, determining whether said telephone communication link is authorized by comparing a caller identification number associated with said telephone communication link with a reference caller identification.

* * * * *